US011819173B2

(12) United States Patent
Feng et al.

(10) Patent No.: US 11,819,173 B2
(45) Date of Patent: Nov. 21, 2023

(54) CLEANING DEVICE

(71) Applicant: SHENZHEN SILVER STAR INTELLIGENT GROUP CO., LTD., Shenzhen (CN)

(72) Inventors: Shang Feng, Shenzhen (CN); Lirong Ye, Shenzhen (CN); Ruijun Yan, Shenzhen (CN); Changtai Xia, Shenzhen (CN); Xiao Hu, Shenzhen (CN)

(73) Assignee: SHENZHEN SILVER STAR INTELLIGENT GROUP CO., LTD., Shenzhen (CN)

( * ) Notice: Subject to any disclaimer, the term of this patent is extended or adjusted under 35 U.S.C. 154(b) by 328 days.

(21) Appl. No.: 17/001,983

(22) Filed: Aug. 25, 2020

(65) Prior Publication Data

US 2021/0186290 A1 Jun. 24, 2021

(51) Int. Cl.
*A47L 11/30* (2006.01)
*A47L 11/40* (2006.01)

(52) U.S. Cl.
CPC ..... *A47L 11/302* (2013.01); *A47L 11/4016* (2013.01); *A47L 11/4027* (2013.01); *A47L 11/4041* (2013.01); *A47L 11/4044* (2013.01); *A47L 11/4083* (2013.01); *A47L 2201/00* (2013.01)

(58) Field of Classification Search
CPC ..... A47L 11/4016; A47L 2201/00; A47L 11/4027; A47L 11/292; A47L 11/302; A47L 11/34
USPC ..... 15/347
See application file for complete search history.

(56) References Cited

U.S. PATENT DOCUMENTS 3,354,496 A * 11/1967 Jonsson ..... A47L 5/30 15/377
10,912,436 B2 * 2/2021 Li ..... A47L 11/4044
11,540,689 B2 * 1/2023 Johnson ..... A47L 11/4016

FOREIGN PATENT DOCUMENTS

CN 201814516 U * 5/2011
CN 201814516 U 5/2011
CN 202341952 U * 7/2012
CN 205181256 U 4/2016
CN 108903843 A 11/2018
CN 109008834 A 12/2018
(Continued)

OTHER PUBLICATIONS

Translation of CN 201814516 U (Year: 2022).*
(Continued)

*Primary Examiner* — Don M Anderson
*Assistant Examiner* — Sarah Akyaa Fordjour
(74) *Attorney, Agent, or Firm* — Gang Yu

(57) ABSTRACT

The disclosure relates to the technical field of cleaning devices, and discloses a cleaning device. The cleaning device includes a machine body, a front bumper, a cleaning assembly, a collecting assembly and a water tank. The machine body is provided with a recess, and the cleaning assembly includes a roller for cleaning the ground. The roller is mounted between the machine body and the front bumper. The collecting assembly is provided with a wastewater outlet and mounted between the machine body and the roller and abuts against the roller. The water tank is provided with a wastewater inlet and is removably mounted in the recess. The wastewater flows into the water tank through the wastewater outlet and the wastewater inlet.

19 Claims, 22 Drawing Sheets

(56) References Cited

FOREIGN PATENT DOCUMENTS

| | | | | |
|---|---|---|---|---|
| CN | 208740869 | U | | 4/2019 |
| CN | 209172208 | U | * | 7/2019 |
| CN | 110881911 | A | | 3/2020 |
| CN | 110897561 | A | | 3/2020 |
| CN | 111150339 | A | | 5/2020 |
| EP | 3524120 | A2 | | 8/2019 |
| JP | H09253015 | A | | 9/1997 |
| WO | WO2018039890 | A1 | * | 8/2016 |
| WO | 2021120630 | A1 | | 6/2021 |

OTHER PUBLICATIONS

Translation of CN209172208U (Year: 2022).*
Translation of WO 2018039890 A1 (Year: 2022).*
Machine translation of CN 202341952 U (Year: 2023).*

* cited by examiner

CLEANING DEVICE

CROSS-REFERENCE TO RELATED APPLICATIONS

This application is based upon and claims priority to Chinese Patent Application No. CN201911330593.7, filed on Dec. 20, 2019, the entire contents of which are incorporated herein by reference.

TECHNICAL FIELD

The disclosure relates to the technical field of cleaning devices, and particularly to a cleaning device.

BACKGROUND

With the rise of smart home devices, as one of the representatives, the floor scrubber is widely used in various places. The floor scrubber is able to intelligently clean the ground, replacing the tedious manual cleaning work.

Generally, the floor scrubber carries a wiper to clean the ground. The wiper that has used to clean the ground carries the wastewater and trash, and the wastewater and trash are squeezed into the water filter tank.

Obviously, while the trash and wastewater coexist in the water filter tank, the trash will also occupy certain volume, so that the water filter tank will be filled too quickly, causing the user to replace the water filter tank frequently.

SUMMARY

There is provided a cleaning device according to embodiments of the present disclosure.

According to an aspect of embodiments of the present disclosure, there is provided a cleaning device, comprising:

a machine body provided with a recess;

a front bumper mounted on the machine body;

a cleaning assembly comprising a roller configured to clean the ground, wherein the roller is mounted between the machine body and the front bumper;

a collecting assembly provided with a wastewater outlet, wherein the collecting assembly is mounted between the machine body and the roller, abutting against the roller and configured to collect and separate trash and wastewater carried by the cleaning assembly; and a water tank provided with a wastewater inlet, wherein the water tank is removably mounted in the recess, and the wastewater flows into the water tank through the wastewater outlet and the wastewater inlet.

BRIEF DESCRIPTION OF THE DRAWINGS

One or more embodiments are exemplified by the corresponding drawings. These exemplary descriptions do not limit the embodiments. Elements with the same reference numerals in the drawings represent similar elements, unless otherwise indicated. Figures in the drawings do not constitute a scale limitation.

DETAILED DESCRIPTION

In order to facilitate understanding of the present disclosure, the present disclosure will be described in more detail with reference to the accompanying drawings and embodiments. It will be understood that when an element is referred to as being "fixed to"/"attached to"/"mounted to" another element, it may be directly on the other element or there may be one or more elements therebetween. When an element is referred to as being "connected" to another element, it may be directly connected to the other element or there may be one or more elements therebetween. The terms "vertical," "horizontal," "left," "right," "inner," "outer," and the like as used herein are for purposes of description only.

Unless otherwise defined, all technical and scientific terms used in this description have the same meaning as commonly understood by those skilled in the art. The terminology used in the description of the present disclosure is only for the purpose of describing specific embodiments, and is not intended to limit the present disclosure. The term "and/or" as used in the specification includes any and all combinations of one or more related listed items.

In addition, the technical features involved in different embodiments of the present disclosure described below may be combined as long as there is no conflict with each other.

In this specification, "mounting" includes welding, screwing, snapping, gluing, etc. to fix or restrict an element or device to a specific position or place, and the element or device may be held at a specific position or place, or it may be movable within a limited range. The element or device may be removable or non-removable after being fixed or limited to a specific position or place, which is not limited in the embodiments of the present disclosure.

Figure 1:
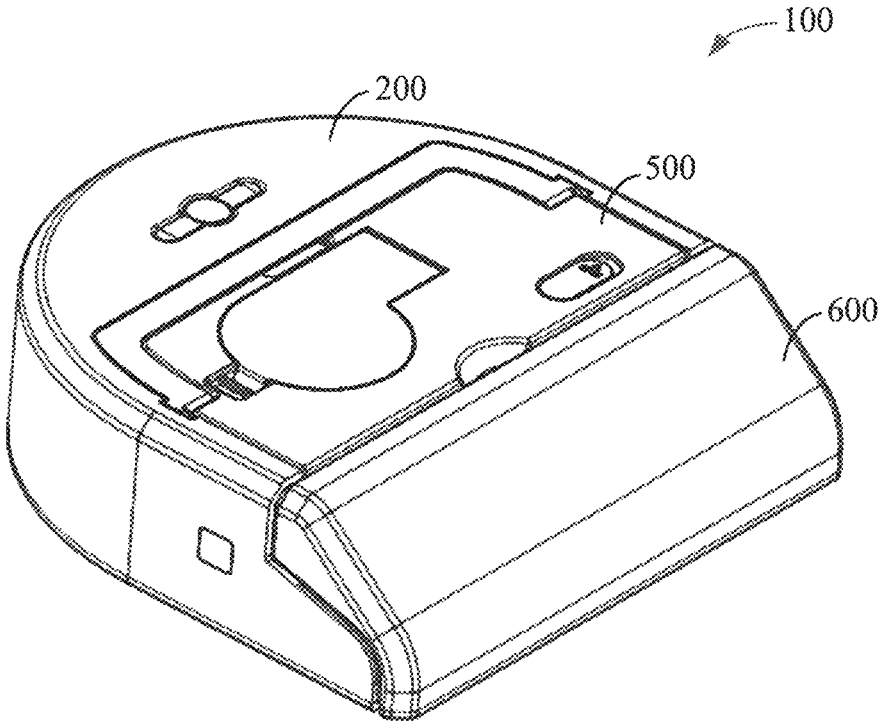
FIG. 1 is a schematic structural view of a cleaning device according to an embodiment of the present disclosure.
Figure 2:
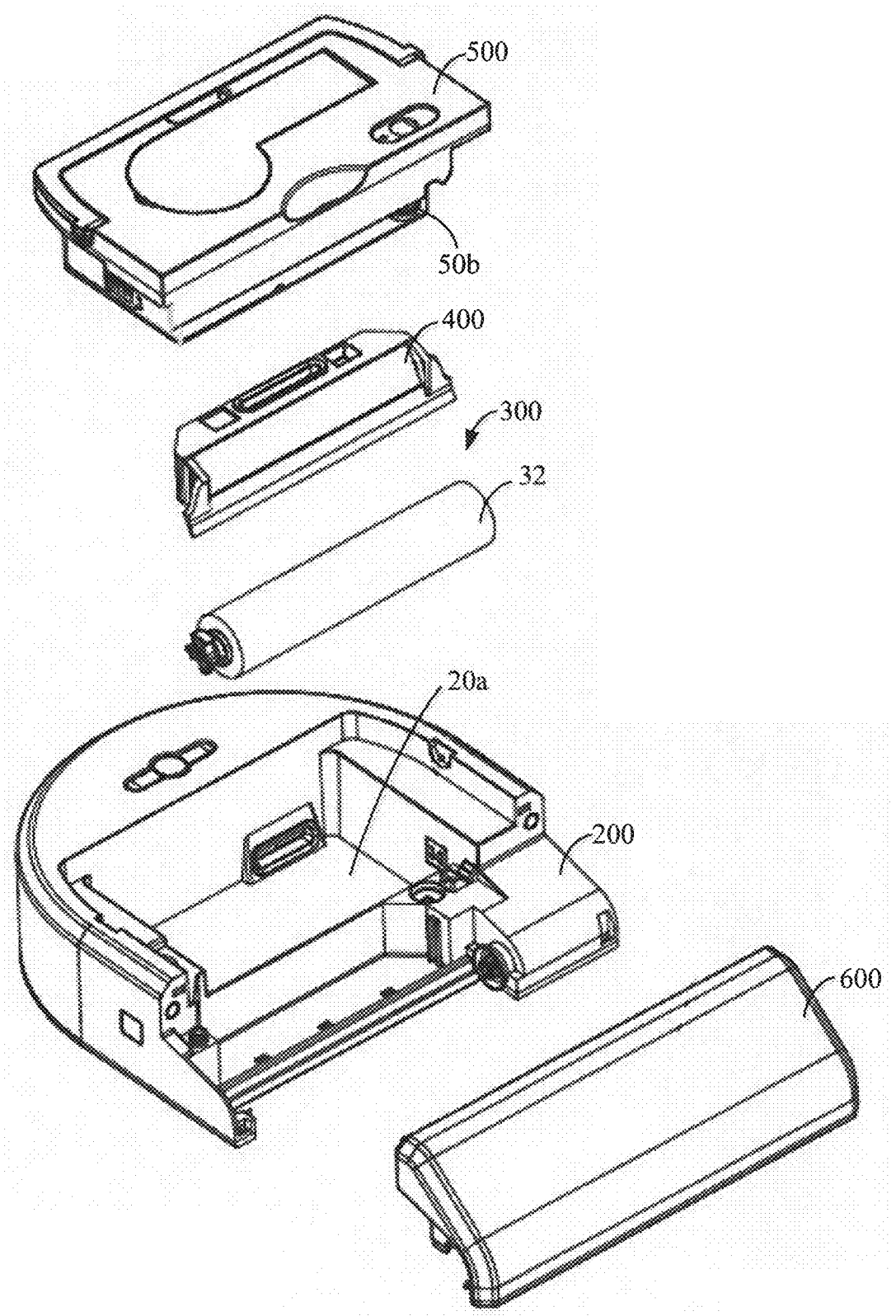
FIG. 2 is an exploded schematic view of a cleaning device according to an embodiment of the present disclosure.
Figure 3:
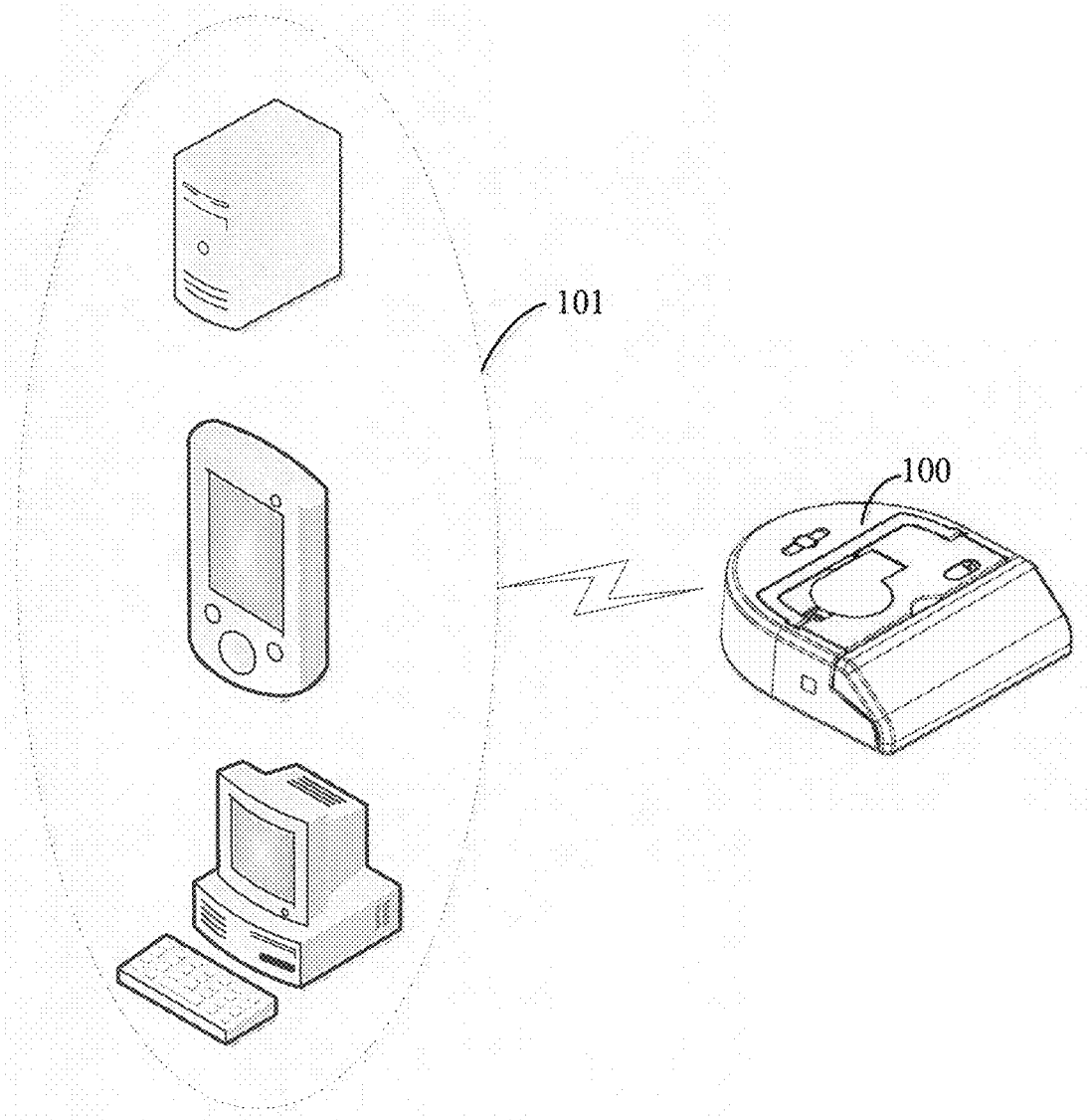
FIG. 3 is a schematic architecture view of a communication between a cleaning device and a processing terminal according to an embodiment of the present disclosure.

Please referring to FIG. 1 to FIG. 3, an embodiment of the present disclosure provides a cleaning device 100, including a machine body 200, a cleaning assembly 300, a collecting assembly 400, a water tank 500, and a front bumper 600.

The cleaning device 100 may include a floor scrubber, a mopping machine, a sweeping robot, and so on. The cleaning device 100 may be constructed in any shape, which may travel on the surface of the ground, a blanket, etc., in order to clean the dirt on the corresponding surface. As shown in FIG. 1, the cleaning device 100 is constructed like a truncated cone.

It may be understood that the cleaning device 100 may be configured with the automatic navigation and obstacle avoidance functions. During the cleaning process, the cleaning device 100 may automatically navigate to complete the cleaning work, and may also automatically prevent from colliding with the obstacles, when encountering obstacles during cleaning.

Figure 4:
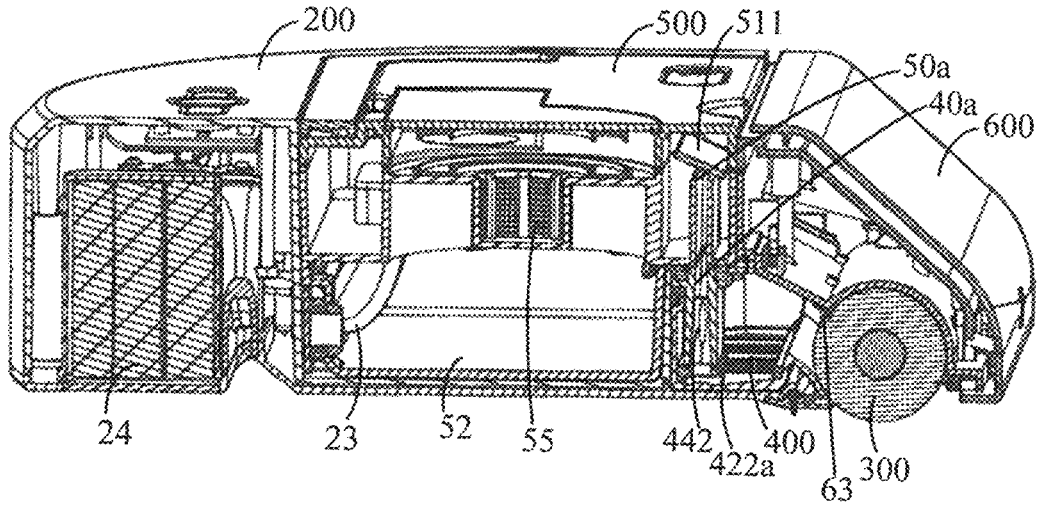
FIG. 4 is a first cross-sectional schematic view of a cleaning device according to an embodiment of the present disclosure.

It may be understood that, referring to FIG. 4, the cleaning device 100 may be communicatively connected to the external processing terminal 101 to form an interaction with each other. The cleaning device 100 may notify the processing terminal 101 of the cleaning status, and the processing terminal 101 may send a cleaning command to the cleaning device to control the cleaning device to complete the cleaning work. The processing terminal 101 may be a mobile phone, a computer, a smart watch, a server, and so on.

The machine body 200 is provided with a recess 20*a*, and the water tank 500 is removably mounted in the recess 20*a*. For example, the machine body 200 is provided with a plurality of slot positions, and the water tank 500 is provided with a plurality of protrusions. When the water tank 500 needs to be mounted in the recess 20*a*, the protrusion of the water tank 500 just needs to be aligned with the slot position of the machine body 200 and snaps thereinto, in order to mount the water tank 500 to the recess 20*a*. Since both the water tank 500 and the machine body 200 are removable from each other, users may replace or renew the water tank 500 at any time, thereby improving the user experience.

In the embodiment, the recess 20*a* is provided in the middle of the machine body 200. As the water tank 500 is mounted in the machine body 200, the machine body 200 surrounds the water tank 500. Therefore, while the machine body 200 moves, the water tank 500 may be reliably fixed inside the machine body 200.

The cleaning assembly 300 is mounted to the machine body 200 and is driven to clean by the machine body 200. The cleaning assembly 300 may be constructed of any cleaning member with a suitable structure, and may complete the cleaning process by any suitable cleaning method, for example, by a roller type cleaning, a rotary type cleaning, and the like. For example, the cleaning assembly 300 comprises a roller 32, which is mounted between the machine body 200 and the front bumper 600 and abuts against the front bumper 600. As the cleaning device 100 travels, the roller 32 is taken to rotate. Since the roller 32 will carry a wiper such as a rag to complete the cleaning of the ground, the wiper will therefore carry the trash and wastewater and follow the rolling of the roller 32.

The collecting assembly 400 is provided with a wastewater outlet 40*a*. The collecting assembly 400 is mounted between the machine body 200 and the roller 32 and abuts against the roller 32 for collecting and separating the trash and wastewater carried by the cleaning assembly 300.

The water tank 500 is provided with a wastewater inlet 50*a*. When the water tank 500 is mounted to the recess 20*a*, the wastewater inlet 50*a* is communicated with the wastewater outlet 40*a*, and the wastewater may flow into the water tank 500 through the wastewater outlet 40*a* and the wastewater inlet 50*a*. The wastewater may be naturally guided into the water tank 500, or may flow into the water tank 500 by other forces. For example, the machine body 200 may be provided with a fan which generates the wind power, and the wastewater is drawn into the water tank 500 through the wastewater outlet 40*a* and the wastewater inlet 50*a* under the action of the wind force.

In the embodiment, when cleaning is required, the user mounts the water tank 500 in the recess 20*a* of the machine body 200. While the cleaning device 100 travels, the roller 32 is taken to clean the ground, and the wastewater or trash will be carried by the roller 32. Since the collecting assembly 400 abuts against the roller 32, while the roller 32 is rotating with the trash and wastewater, the collecting assembly 400 squeezes the roller 32 so that the trash and wastewater on the roller 32 enter the collecting assembly 400. The collecting assembly 400 separates the trash and wastewater. On the one hand, the trash is left in the cavity of the collecting assembly 400; on the other hand, the separated wastewater is discharged from the collecting assembly 400, and may flow into the water tank 500. Therefore, the cleaning device 100 realizes the separation of trash and wastewater. After cleaning, the user may take out the water tank 500 and the collecting assembly 400 from the recess 20*a* of the machine body 200, manually dump the wastewater and other trash in the water tank 500, and also manually dump the trash left in the collecting assembly 400.

The front bumper 600 is removably mounted to the machine body 200, and the cleaning assembly 300 is located between the machine body 200 and the front bumper 600. When the cleaning device 100 encounters an obstacle during traveling, the front bumper 600 may effectively buffer the collision between the cleaning assembly 300 and the obstacle, therefore may protect the cleaning assembly 300 and the machine body 200 more effectively.

Figure 5:
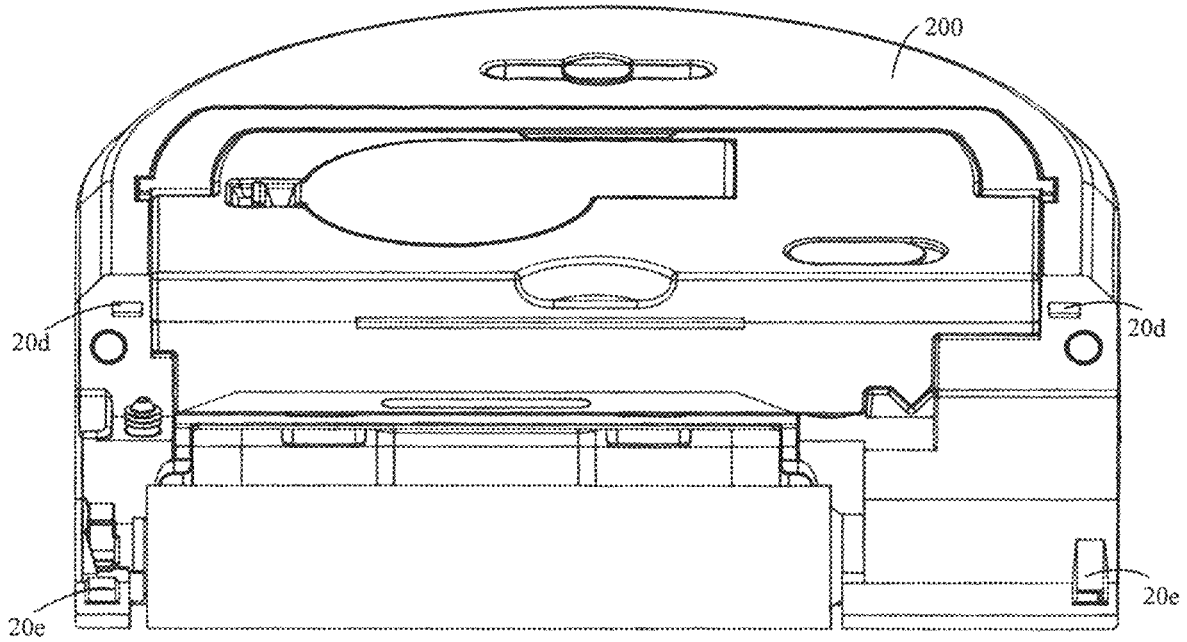
FIG. 5 is a front view of the machine body shown in FIG. 1.
Figure 6:
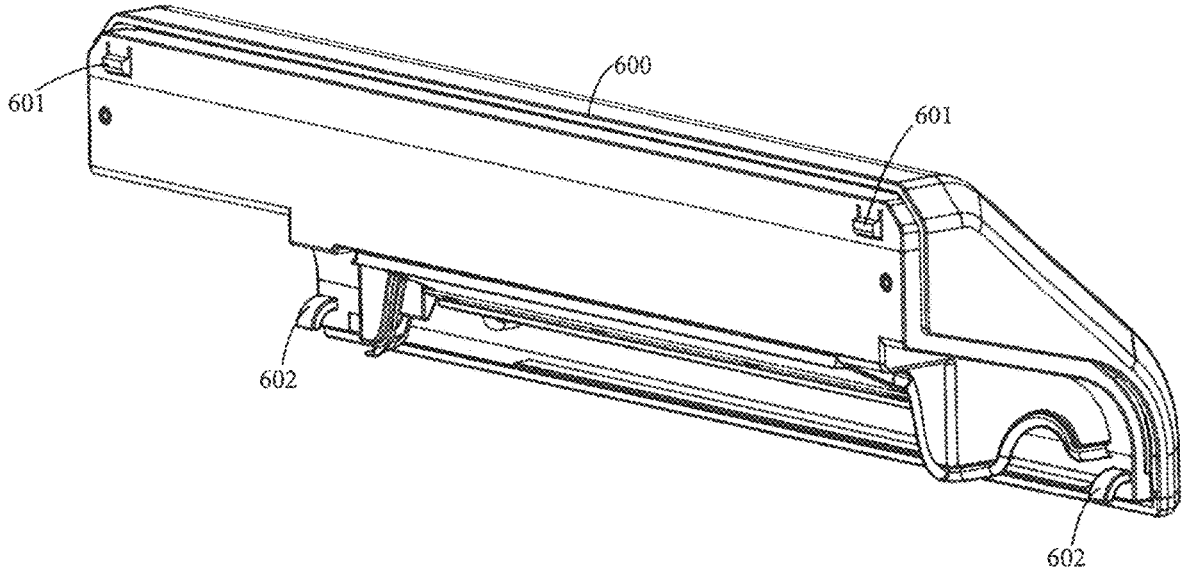
FIG. 6 is a perspective structural diagram of the front bumper shown in FIG. 1.

In some embodiments, referring to FIGS. 5 and 6, the side of the front bumper 600 towards the direction of the machine body 200 is provided with a first engagement rib 601, and the side of the machine body 200 towards the direction of the front bumping 600 is provided with an engagement recess 20*d*. While the front bumper 600 is mounted to the machine body 200, the engagement rib 601 is engaged with the engagement recess 20*d*. When the front bumper 600 needs to be removed from the machine body 200, the engagement rib 601 may be directly pulled out of the engagement recess 20*d*.

It may be understood that, for mounting and fixing reliably, the number of the engagement rib 601 may be more than one, and correspondingly, the number of the engagement recess 20*d* may be more than one.

It may be understood that the engagement rib 601 may be an elastic engagement rib. By the elastic engagement rib, the front bumper 600 may be more quickly and flexibly mounted to the machine body 200 or removed from the machine body 200.

In some embodiments, in order to further secure the front bumper 600 to the machine body 200 reliably, referring to FIG. 5 and FIG. 6 again, the side of the front bumper 600 towards the direction of the machine body 200 is also provided with a rotary framework 602, and the side of the machine body 200 towards the direction of the front bumper 600 is also provided with a rotary slot 20*e*. While the front bumper 600 is mounted to the machine body 200, the rotary framework 602 is rotated and buckled in the rotary slot 20*e*. When the front bumper 600 needs to be removed from the machine body 200, the rotary framework 602 may be directly pulled out of the rotary slot 20*e*.

In some embodiments, the front bumper 600 may be omitted or may be retained in the cleaning device 100.

In the embodiment, while the cleaning assembly 300 is working, it will carry wastewater and trash to the collecting assembly 400, so that the collecting assembly 400 may perform collecting and separating operations. In some embodiments, the collecting assembly 400 may be constructed in any suitable structure.

Figure 7A:
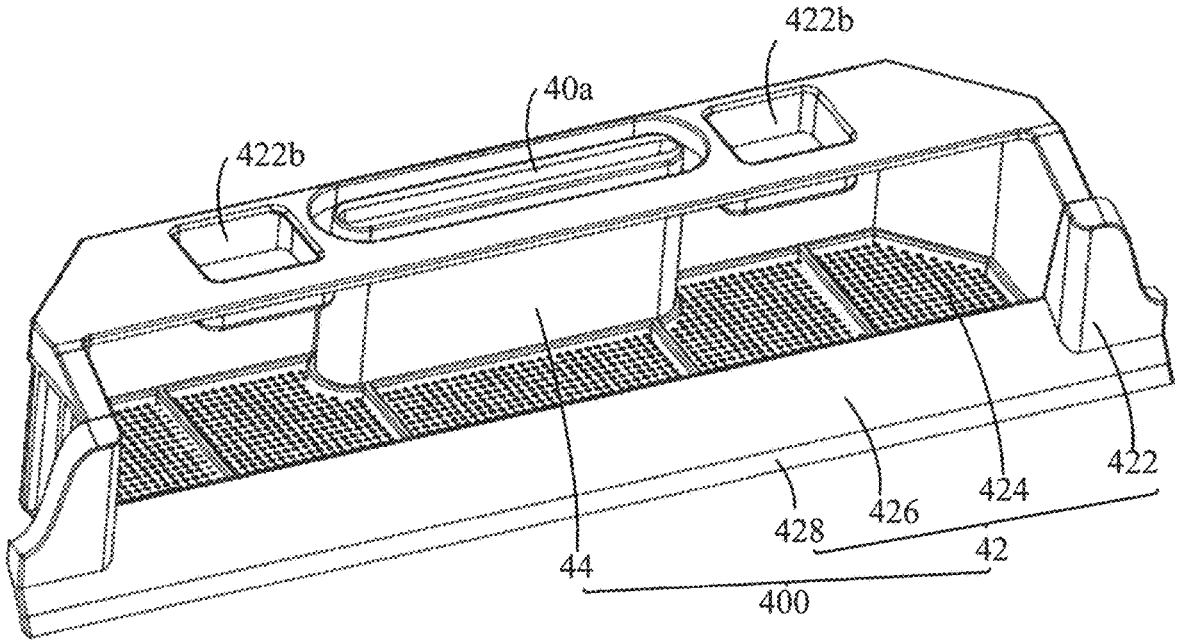
FIG. 7*a* is a perspective structural view of the collecting assembly in FIG. 1.

Please referring to FIG. 7*a*, the collecting assembly 400 includes a separating assembly 42 and a flowing tube 44.

The separating assembly 42 is mounted in the machine body 200 and abuts against the cleaning assembly 300. While the cleaning assembly 300 carries the trash and wastewater, the separating assembly 42 may squeeze the cleaning assembly 300 so that the wastewater and trash on the cleaning assembly 300 are brought into the separating assembly 42. Then, the separating assembly 42 may collect and separate the trash and wastewater carried by the cleaning assembly 300.

The flowing tube 44 is mounted on the separating assembly 42. The flowing tube 44 is communicated with the separating assembly 42. The flowing tube 44 is provided with a wastewater outlet 40*a*, and the separated wastewater may flow into the flowing tube 44.

The machine body 200 provides wind power, and the separated wastewater enters the flowing tube 44 under the action of the wind force, and then enters the wastewater inlet 50*a* of the water tank 500 from the wastewater outlet 40*a* of the flowing tube 44.

In some embodiments, the separating assembly 42 includes a separating main board 422, a first filter 424, a transition plate 426 and a first scraping bar 428.

The separating main board 422 is removably mounted in the machine body 200 and is provided with a filter groove 422*a*. The flowing tube 44 is mounted on the separating main board 422 and is communicated with the filter groove 422*a*.

The first filter 424 is mounted in the notch of the filter groove 422*a*, and is configured to collect and separate the trash and wastewater carried by the cleaning assembly 300.

It may be understood that the first filter 424 may adopt any suitable filter structure, such as a mesh structure and the like.

The transition plate 426 is mounted on the separating main board 422 and abuts against the cleaning assembly 300. In some embodiments, the end of the transition plate 426 towards the cleaning assembly 300 is bent vertically downward to form a slope. The cleaning assembly 300 abuts the transition plate 426. The transition plate 426 and the cleaning assembly 300 squeeze each other. However, the cleaning assembly 300 may move relative to the transition plate 426. Therefore, the trash and wastewater carried by the cleaning assembly 300 are brought into the transition plate 426, and then brought into the separating main board 422 from the transition plate 426.

The first scraping bar 428 is mounted at the abutment of the transition plate 426 and the cleaning assembly 300. The first scraping bar 428 may scrape off the trash or other litter attached to the cleaning assembly 300.

In the embodiment, when the trash and wastewater are brought into the collecting cavity of the separating main board 422, the trash is isolated outside by the first filter 424, and the wastewater flows into the flowing tube 44 under the action of the wind force after filtered by the first filter 424.

In some embodiments, the separating main board 422 is provided with a positioning groove 422*b*, and the water tank 500 is provided with a positioning protrusion 50*b*. As the positioning protrusion 50*b* is engaged with the positioning groove 422*b*, the wastewater inlet 50*a* is communicated with the wastewater outlet 40*a*.

With such a structure, on the one hand, when the separating main board 422 needs to be removed, since the positioning protrusion 50*b* of the water tank 500 is engaged with the positioning groove 422*b* of the separating main board 422, the water tank 500 needs to be removed from the recess 20*a* of the machine body 200 before the separating main board 422 may be removed, so as to further prevent the separating main board 422 from popping out during the cleaning process. On the other hand, by virtue of the positioning of the positioning groove 422*b* and the positioning protrusion 50*b*, the wastewater inlet 50*a* and the wastewater outlet 40*a* may be communicated with each other efficiently, avoiding cumbersome interface docking processes.

In some embodiments, in order to accelerate the flow of wastewater into the water tank 500, the flowing tube 44 includes a tube body 441 and a flow-guiding part 442. One end of the tube body 441 is communicated with the separating assembly, and the other end of the tube body 441 is provided with a wastewater outlet 40*a*. The flow-guiding part 442 is mounted in the tube body 441, and the wastewater may quickly be guided to flow out of the wastewater outlet 40*a* and then flow into the water tank 500 by the diversion effect of the flow-guiding part 442

Figure 7B:
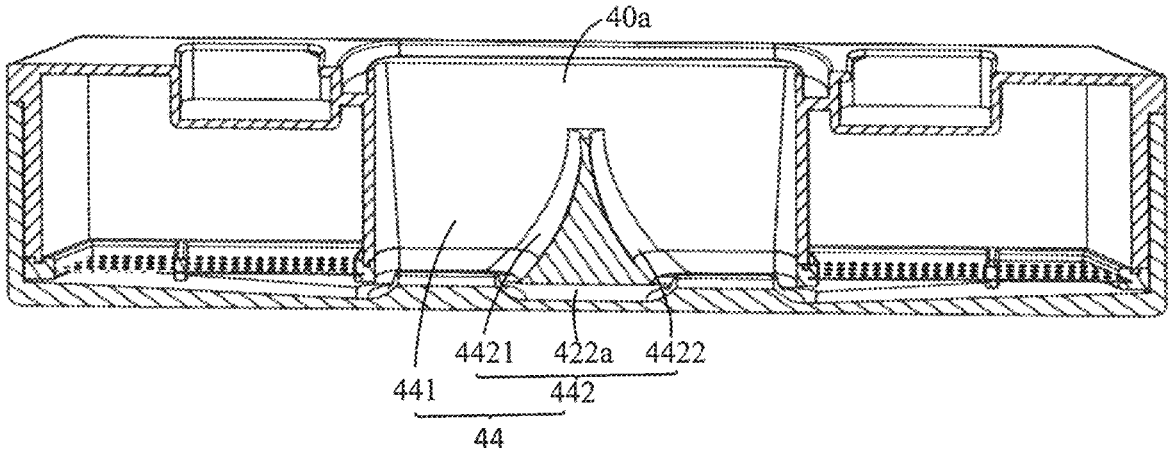
FIG. 7*b* is a schematic cross-sectional view of FIG. 7*a;*

Please referring to FIG. 7*b*, the flow-guiding part 442 includes a first curved surface portion 4421 and a second curved surface portion 4422. The first curved surface portion 4421 and the second curved surface portion 4422 cooperate with each other to form a guiding channel, and the width of the guiding channel gradually narrows from one end to the other in the vertical upward direction, so that the wastewater may quickly flow into the water tank 500 through the guiding channel.

In some embodiments, the first curved surface portion 4421 is protruded from the inner wall of the flowing tube 44, and the second curved surface portion 4422 is protruded from the inner wall of the flowing tube 44 and is opposite to the first curved surface portion 4421. The wastewater may slide on the inner surface of the first curved surface portion 4421 or the second curved surface portion 4422 towards the center of curvature, and the wastewater from various directions may slide on the inner surface of the first curved surface portion 4421 or the second curved surface portion 4422 respectively to be quickly guided out of the wastewater outlet 40*a*.

It may be understood that the first curved surface portion 4421 and the second curved surface portion 4422 are both arc-shaped.

It may also be understood that any inner wall of the flowing tube 44 may be provided with a curved surface portion, so as to guide the wastewater out in multiple directions more quickly.

It may also be understood that the flow-guiding part 442 may be constructed to any flow-guiding shape, and is not limited to the curved flow-guiding structure provided in the embodiment.

As described above, the wastewater is drawn into the water tank 500 for storage. When the user needs to dump the wastewater in the water tank 500, the user needs to manually remove the water tank 500 from the recess 20*a* of the machine body 200. However, the water tank 500 often stores the wastewater. During the removal process, the wastewater will be bumped and thrown out to the external environment which causes the secondary pollution and greatly reduces the user experience.

Accordingly, in order to prevent the wastewater from being thrown out to the external environment during the removal of the water tank 500 from the main body 200, the embodiments of the disclosure may be provided with a corresponding sealing assembly, in order to seal the wastewater inlet 50*a* of the water tank 500 during removing the water tank 500. Please referring to FIG. 8*a* to FIG. 8*d*, the water tank 500 includes a first sealing assembly 51. The first sealing assembly 51 is movably mounted in the wastewater inlet 50*a* and may rotate around the baseline Ma relative to the wastewater inlet 50*a* to seal the wastewater inlet 50*a* or open the wastewater inlet 50*a*.

For example, when the water tank 500 is placing in the recess 20*a*, the machine body 200 acts on the first sealing assembly 51, so that the first sealing assembly 51 rotates around the baseline 51*a* in a first direction relative to the wastewater inlet 50*a* to open the wastewater inlet 50*a*.

When the water tank 500 is moving out of the recess 20*a*, the first sealing assembly 51 rotates around the baseline 51*a* in a second direction relative to the wastewater inlet 50*a* to seal the wastewater inlet 50*a*.

The first sealing assembly 51 includes a sealing flap plate 511, a linkage transmission mechanism 512, and sealing foam 513.

The sealing flap plate 511 is movably mounted in the water tank 500 and abuts against the wastewater inlet 50*a*.

Please referring to FIGS. 8*a* to 8*d*, the water tank 500 is provided with a first rotation hole 50*b* and a second rotation hole 50*c*, and the sealing flap plate 511 is provided with a first rotation protrusion 511*b* and a second rotation protrusion 511*c*. The first rotation protrusion 511*b* is mounted in the first rotation hole 50*b*, and the second rotation protrusion 511*c* is mounted in the second rotation hole 50*c*. The baseline 51*a* penetrates the first rotation hole 50*b* and the second rotation hole 50*c*.

Under the action of an external force, the sealing flap plate 511 may rotate clockwise or counterclockwise with the first rotation hole 50*b* and the second rotation hole 50*c* as two fulcrums.

It may be understood that the mounting between the first rotation protrusion 511*b* and the first rotation hole 50*b*, or the mounting between the second rotation protrusion 511*c* and the second rotation hole 50*c* may be a threaded mounting method, or may be bearing mounting and so on.

In some embodiments, the sealing flap plate 511 has a rectangular shape, which may completely seal the wastewater inlet 50*a*.

The linkage transmission mechanism 512 is connected to the sealing flap plate 511, and the linkage transmission mechanism 512 may be a transmission mechanism constructed of any suitable structure.

When the machine body 200 applies a force to the linkage transmission mechanism 512, the linkage transmission mechanism 512 drives the sealing flap plate 511 to rotate around the baseline 51*a* in a first direction relative to the wastewater inlet 50*a*, so that the sealing flap plate 511 opens the wastewater inlet 50*a*.

When the water tank 500 is removing from the machine body 200, the linkage transmission mechanism 512 drives the sealing flap plate 511 to rotate around the baseline 51*a* in a second direction relative to the wastewater inlet 50*a*, so that the sealing flap plate 511 seals the wastewater inlet 50*a*.

Therefore, with such a sealing structure, on the one hand, the wastewater inlet 50*a* may be effectively opened when the water tank 500 is mounted in the machine body 200, so that the wastewater inlet 50*a* is communicated with the wastewater outlet 40*a*, and then be normally collected into the water tank 500. On the other hand, it may effectively prevent the wastewater from being thrown out to the external environment from the water tank 500 as the water tank 500 is separated from the machine body 200, and avoid causing secondary pollution.

The sealing foam 513 is arranged on the surface of the sealing flap plate 511 facing the wastewater inlet 50*a*, and the sealing foam 513 may seal the wastewater inlet 50*a* more effectively.

It may be understood that, in some embodiments, the sealing foam 513 may be omitted or may be retained.

In some embodiments, the linkage transmission mechanism 512 includes a lifting pin 5121 and a first resilient member 5122.

One end of the lifting pin 5121 is connected to the sealing flap plate 511, and the other end of the lifting pin 5121 is suspended toward the machine body 200. As shown in FIG. 8*b*, the lower cover 501 of the water tank 500 is provided with a throught hole 50*e*, and the opening surface of the throught hole 50*e* is placed with an O-ring 502 and a gasket 503 in sequence, and the shaft holes of the O-ring 502 and the gasket 503 are communicated with the throught hole 50*e*. The O-ring 502 is pressed against the lower cover 501 by the gasket 503 through thread fixing, and one end of the lifting pin 5121 passes through the throught hole 50*e* and is connected with the sealing flap plate 511. The lifting pin

5121 may be moved up and down in the throught hole 50*e* under the action of force. When the lifting pin 5121 is moved upward, the sealing flap plate 511 is pushed to rotate by the lifting pin 5121.

In some embodiments, in order to enable the lifting pin 5121 to be moved up and down in the throught hole 50*e* with high accuracy and reliability, the inside of the throught hole 50*e* is provided with an axle sleeve 504, which is sleeved on the lifting pin 5121, so that the axle sleeve 504 may assist the lifting pin 5121 to be moved up and down with high accuracy and without offset.

The first resilient member 5122 bears against the water tank 500 at one end and the sealing flap plate 511 at the other end. When an external force acts on the lifting pin 5121, the lifting pin 5121 is lifted to make the sealing flap plate 511 turn over in order to open the wastewater inlet 50*a*. At this time, the first resilient member 5122 is in a compressed state. When the external force is removed from the lifting pin 5121, the first resilient member 5122 in a compressed state stretches, causing the sealing flap plate 511 to turn over to seal the wastewater inlet 50*a*. At this time, the first resilient member 5122 may still be in a compressed state.

In order to improve the reliability of the first resilient member 5122 and prevent the first resilient member 5122 from popping out of its original position during compression, in some embodiments, the sealing flap plate 511 is provided with a through hole 511*a*. The other end of the first resilient member 5122 passes through the through hole 511*a* and is connected to the sealing flap plate 511, wherein the axis of the first resilient member 5122 intersects the axis of the through hole 511*a*. Since the first resilient member 5122 is obliquely fitted in the through hole 511*a*, the first resilient member 5122 is connected to the sealing flap plate 51, and when the first resilient member 5122 is compressed by the sealing flap plate 511, the first resilient member 5122 may always be connected to the sealing flap plate 511, and not easy to pop out of the original position, thereby improving the sealing reliability.

In the present embodiment, while the machine body 200 bears against the other end of the lifting pin 5121, one end of the lifting pin 5121 bears against the sealing flap plate 511 to rotate around the baseline 51*a* in a first direction relative to the wastewater inlets 50*a*, such that the sealing flap plate 511 opens the wastewater inlet 50*a*.

While the water tank 500 is removed out of the machine body 200, the sealing flap plate 511 is pushed by the first resilient member 5122 to rotate around the baseline 51*a* in a second direction relative to the wastewater inlet 50*a*, so that the sealing flap plate 511 seals the wastewater inlet 50*a*.

Therefore, the water tank with such a sealing structure may prevent the wastewater in the water tank 500 from throwing out of the water tank 500 while the user removes the water tank 500 out of the machine body.

In order to improve the reliability of the sealing flap plate 511 sealing the wastewater inlet 50*a*, in some embodiments, the linkage transmission mechanism 512 further includes a torsion spring 5123. The sealing flap plate 511 is provided with a positioning column 5110, and the torsion spring 5123 is sleeved on the positioning column 5110. One end of the torsion spring 5123 bears against the sealing flap plate 511, and the other end of the torsion spring 5123 bears against the inner side wall of the water tank 500.

When the sealing flap plate 511 opens the wastewater inlet 50*a*, it presents a certain opening angle with respect to the wastewater inlet 50*a*. At this time, the torsion spring 5123 is carried by the sealing flap plate 511 to twist and the distance between one end of the torsion spring 5123 and the other end becomes smaller, and the torsion spring 5123 is in a compressed state.

When the water tank 500 is removed from the machine body 200, the torsion spring 5123 resets and at this time, the distance between one end of the torsion spring 5123 and the other end becomes longer, and the torsion spring 5123 assists the first resilient member 5122 to accelerate the sealing flap plate 511 to rotate around the baseline 51*a* in the second direction relative to the wastewater inlet 50*a*, so that the sealing flap plate 511 seals the wastewater inlet 50*a*.

As mentioned above, when the wastewater is drain into the water tank 500 under the action of wind force, the wastewater will flow into the wastewater cavity 52 of the water tank 500. Please referring to FIGS. 9*a* to 9*c*, in the embodiment, the wastewater cavity 52 is communicated with the wastewater inlet 50*a*, and the wastewater flows into the wastewater cavity 52 through the wastewater inlet 50*a*.

The wastewater cavity 52 is a semi-closed water storage structure surrounded by several side plates in the water tank 500.

In some embodiments, the wastewater cavity 52 may be provided with a wastewater lever detecting circuit for detecting the wastewater water level in the wastewater cavity 52. For example, the wastewater cavity 52 is provided with a probe component, which is electrically connected to the wastewater level detecting circuit. The wastewater level detecting circuit detects the water storage in the wastewater cavity 52 by the probe component. If the wastewater cavity 52 is full, an alarm signal is generated to inform users to dump the wastewater.

Generally, when the wastewater enters the wastewater cavity 52 through the wastewater inlet 50*a* under the action of wind force, there will always be large particles in the wastewater. The wastewater and particles mixed in the airflow will easily hit the wastewater cavity 52, thereby generating great noise and destroying the wastewater cavity. Besides, the particles may not easily fall into the wastewater cavity 52, and may easily run to other places of the water tank 500. Therefore, in order to avoid the above situation and the like, in some embodiments, the wastewater cavity 52 is cylindrical and is provided with a tangential inlet 52*a* along the circumscribed direction, and the tangential inlet 52*a* is communicated with the wastewater inlet 50*a*.

Figure 9A:
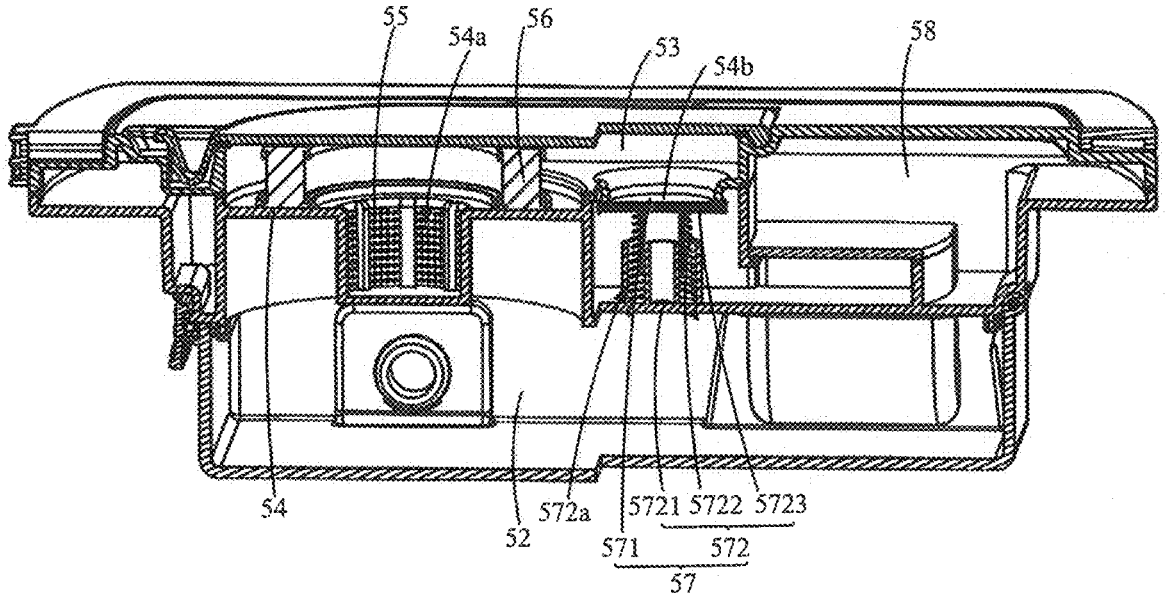
FIG. 9*a* is a second cross-sectional schematic view of a cleaning device according to an embodiment of the present disclosure.
Figure 9B:
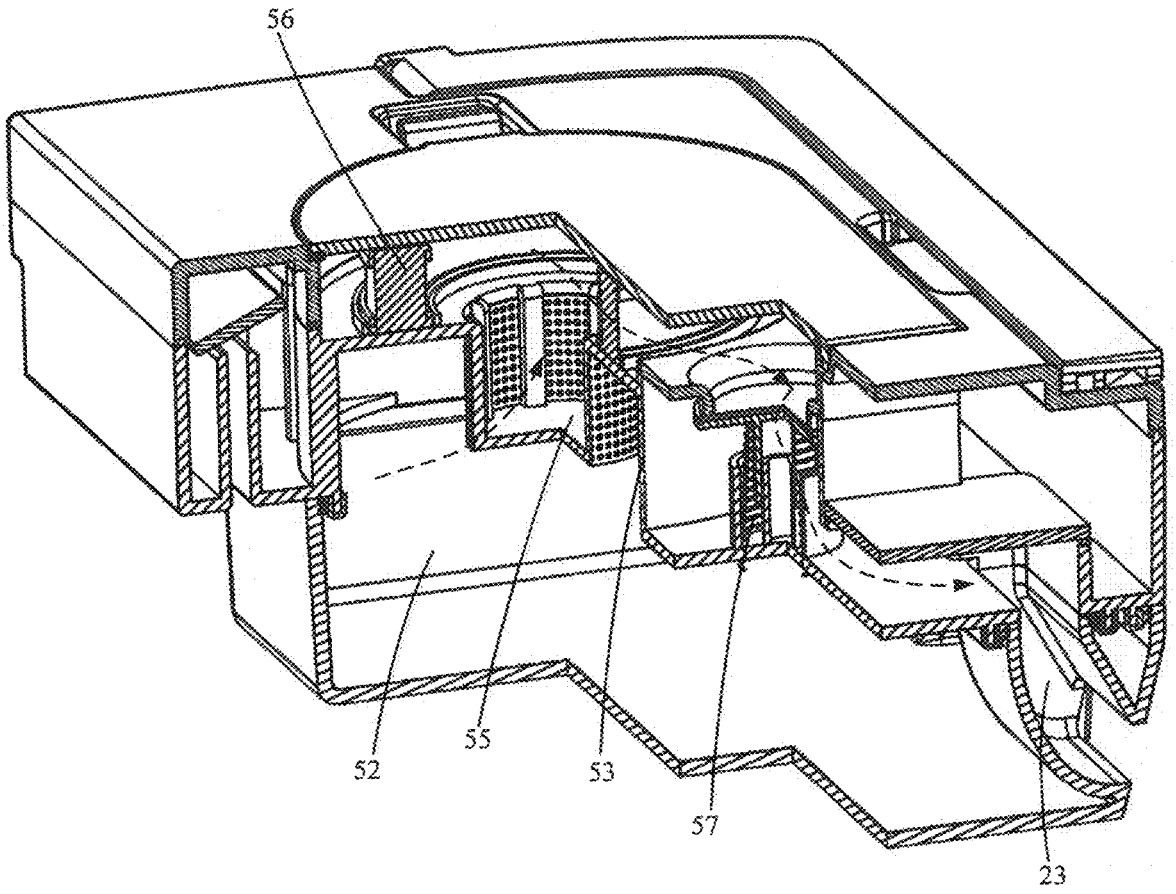
FIG. 9*b* is a third schematic cross-sectional view of a cleaning device according to an embodiment of the present disclosure.
Figure 9C:
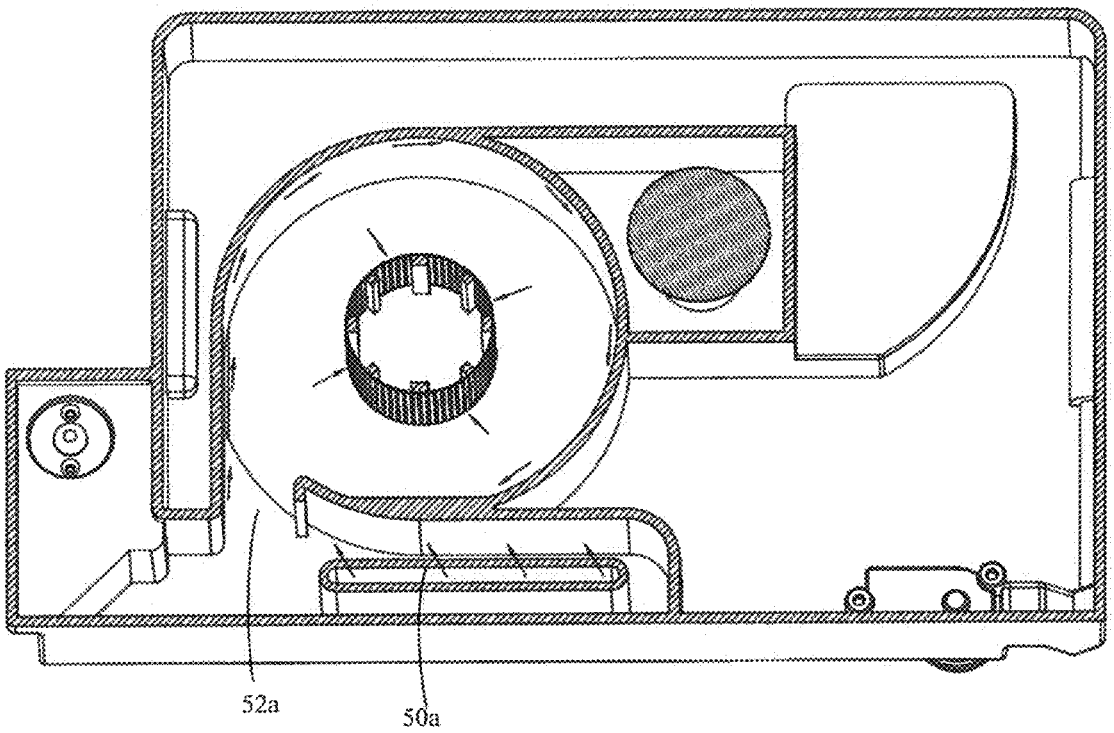
FIG. 9*c* is a first schematic cross-sectional view of a water tank according to an embodiment of the present disclosure.

Therefore, under the action of wind force, as shown by the arrows in FIG. 9*c*, when the wastewater runs out from the wastewater inlet 50*a*, the airflow mixed with wastewater directly centrifugally moves along the tangential inlet 52*a*, where the wastewater caught in the airflow falls into the wastewater cavity 52 by the gravity.

With such a structure of the wastewater cavity 52, on the one hand, the wastewater is affected by the centrifugal movement and is easy to fall into the wastewater cavity 52, therefore may be effectively collected by the wastewater cavity 52. On the other hand, after flowing in the wastewater cavity 52 along the tangential inlet 52*a*, the airflow then rotates along the inner wall of the wastewater cavity 52 to perform centrifugal movement to avoid the airflow carrying the wastewater running around irregularly, and also to avoid random impacts on other structures inside the wastewater cavity 52.

In some embodiments, the water tank 500 further includes an air guiding cavity 53, a partition plate 54, and a second filter 55.

The air guiding cavity 53 is opposite to the wastewater cavity 52. The air guiding cavity 53 provides an airflow channel. Under the action of wind force, the airflow first draws the wastewater into the water tank 500 from the wastewater outlet 40*a* and the wastewater inlet 50*a*, and then flows in from the tangential inlet 52*a* and makes the centrifugal movement. The wastewater falls into the wastewater cavity under the action of gravity, and the airflow which is making the centrifugal movement directly passes through the airflow channel of the air guiding cavity 53 and flows out to the external environment.

In some embodiments, the air guiding cavity 53 is a semi-closed air guiding structure surrounded by several side plates in the water tank 500.

The partition plate 54 is mounted between the wastewater cavity 52 and the air guiding cavity 53. The partition plate 54 is configured to block the wastewater in the wastewater cavity 52 from flowing into the air guiding cavity 53 and to prevent the airflow from running randomly.

In some embodiments, the wastewater cavity 52, the air guiding cavity 53 and the partition plate 54 may be integrally formed, or may be separately formed and then assembled and integrated in the water tank 500.

The partition plate 54 is provided with a filter hole 54*a*, and the second filter 55 is mounted in the filter hole 54*a*. As shown in FIG. 9*a*, the second filter 55 is a cylindrical filter, which surrounds the filter hole 54*a*.

The airflow flows in from the tangential inlet 52*a* and makes the centrifugal movement. The wastewater is collected by the wastewater cavity 52, and the centrifugally-moving airflow flows into the second filter 55, which may further filter out particulate, solid dust and other solid trash like detritus. In general, as shown by the dotted line in FIG. 9*b*, the airflow mixed with the wastewater successively flows out through the wastewater cavity 52, the second filter 55, and the air guiding cavity 53.

By providing the second filter 55, the trash mixed in the airflow may further filter out, for preventing the trash from running to the air guiding cavity 53 and blocking the air guiding cavity 53, and so on.

In order to improve the reliability of filtration, in some embodiments, referring to FIG. 9*a* to FIG. 9*c* again, the water tank 500 further includes a third filter 56, which is mounted in the air guiding cavity 53 and configured to filter the airflow passed through the second filter 55 again. Referring to FIG. 9*a*, the third filter 56 is annular and surrounds the filter hole 54*a* and is opposite to the second filter 55.

In the embodiment, as the third filter 56 is further provided, the second filter 55 may prevent the solid trash from entering the third filter 56, thereby avoiding the situation that the third filter 56 is prone to be fouling and further reducing the frequency of cleaning or replacing the third filter 56.

The third filter 56 not only may further filter out solid trash such as granule, debris, etc., but also has the function of filtering wastewater, preventing the wastewater mixed with the airflow from entering the air guiding cavity 53 from the air outlet.

In some embodiments, the third filter 56 is a HEPA filter. It should be noted that the third filter 56 is not limited to the circular ring shape in the present solution, and in other solutions may also be a plate-shaped filter HEPA, Round-shaped filter HEPA and other filters.

To facilitate removal of the third filter 56 for cleaning or replacement, in some embodiments, the upper surface of the water tank 500 may have an openable cover. When the third filter 56 needs to be cleaned or replaced, the user may manually open the cover to remove the third filter 56.

In some embodiments, when the water tank 500 is mounted on the machine body 200, but the cleaning device 100 is not activated by the user to start cleaning, in order to prevent the wastewater in the water tank 500 from entering the air guiding cavity 53 to affect the fan and other components, in some embodiments, the partition plate 54 is further provided with a sealing hole 54*b*. The water tank 500 further includes a second sealing assembly 57, which is mounted in the sealing hole 54*b* and vertically movable along the axis of the sealing hole 54*b* to open or seal the sealing hole 54*b*.

The second sealing assembly 57 may be in any suitable sealing structure. For example, the second sealing assembly 57 includes a sealing piece and a motor driving mechanism. When the cleaning device 100 is not in operation, the motor driving mechanism drives the sealing piece to seal the sealing hole 54*b*. When the cleaning device 100 is in operation, the motor driving mechanism drives the sealing piece to move away from the sealing hole 54*b* to open the sealing hole 54*b*.

As another example, as shown in FIG. 9*a*, the second sealing assembly 57 includes a sealing sheet 571 and a telescopic mechanism 572.

The sealing sheet 571 is mounted in the sealing hole 54*b*, and the telescopic mechanism 572 is connected to the sealing sheet 571. While the airflow is pressing the sealing sheet 571, the telescopic mechanism 572 carries the sealing sheet 571 moving away from the sealing hole 54*b* along the axis of the sealing hole 54*b* to open the sealing hole 54*b*. when the airflow is not pressing the sealing sheet 571, the telescopic mechanism 572 carrying the sealing sheet 571 moves close to the sealing hole 54*b* along the axis of the sealing hole 54*b* to seal the sealing hole 54*b*.

In some embodiments, in order to automatically seal or open the sealing hole 54*b* under the premise that the airflow is applied or is not applied to the sealing sheet 571, the telescopic mechanism 572 includes a support 5721, a second resilient member 5722, and a bracket 5723.

The support 5721 is provided with a receiving slot 572*a*. One end of the second resilient member 5722 is mounted in the receiving slot 572*a*, the second resilient member 5722 is sleeved on the bracket 5723, and the sealing sheet 571 is connected to the bracket 5723.

When the airflow is applied to the upper surface of the sealing sheet 571, the air pressure causes the bracket 5723 carrying the sealing sheet 571 to compress the second resilient member 5722 and move downward, so that the sealing sheet 571 may open the sealing hole 54*b*.

When the airflow is not applied to the upper surface of the sealing sheet 571, the second resilient member 5722 performs a reset movement and pushes the bracket 5723 to move the sealing sheet 571 upward, so that the sealing sheet 571 may seal the sealing hole 54*b*.

In general, with such a sealing structure, it may effectively prevent wastewater from entering the air guiding cavity 53 when the fan is not working, thereby destroying the fan and the like.

Figure 10A:
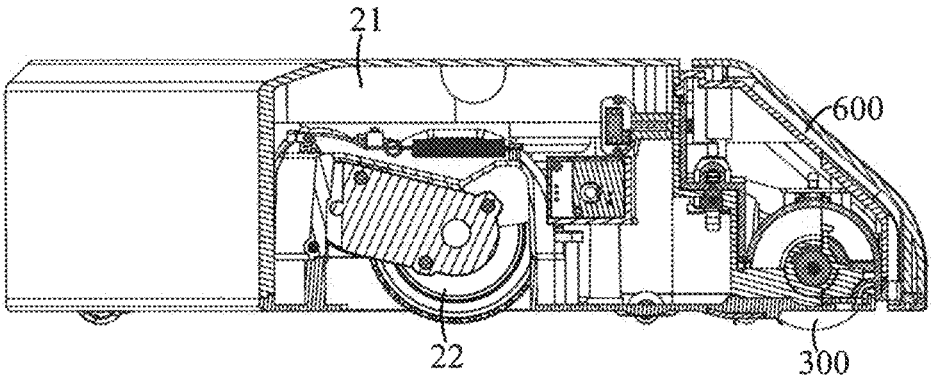
FIG. 10*a* is a fourth cross-sectional schematic view of a cleaning device according to an embodiment of the present disclosure.
Figure 10B:
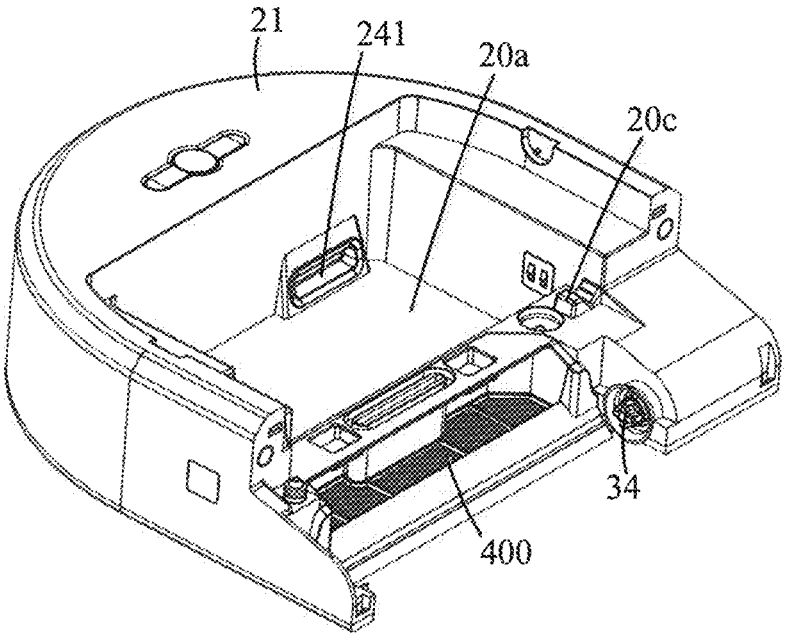
FIG. 10*b* is a perspective structural view of the machine body of FIG. 1 at a second angle.

As mentioned earlier, the machine body 200 provides wind power. In some embodiments, please referring to FIG. 4, FIG. 10*a* and FIG. 10*b*, the machine body 200 includes a main body 21, a driving assembly 22, an exhaust duct 23 and a fan module 24.

The driving assembly 22 is mounted in the main body 21 and configured to drive the main body 21 to travel. In some embodiments, the drive component 22 may adopt any suitable driving structure. For example, the driving assembly 22 includes a drive wheel, a chain transmission mechanism, and a drive motor. The drive motor is connected to the chain transmission mechanism. The chain transmission mechanism is connected to the drive wheel. The drive motor outputs the driving force, and drives the chain transmission mechanism to control the driving wheels to rotate, thereby driving the main body 21 to travel.

The exhaust duct 23 is mounted in the main body 21 and is communicated with the air guiding cavity 53, so that the airflow flowing through the air guiding cavity 53 flows into the exhaust duct 23 again.

The fan module 24 is mounted to the exhaust duct 23 and is configured to provide the wind power. At this time, under the action of the wind force, the wastewater is drain into the water tank 500 through the wastewater outlet 40*a* and the wastewater inlet 50*a*, that is, falls into the wastewater cavity 52, and then, the airflow enters the air guiding cavity 53 after filtered again through the second filter 55 and the third filter 56. The airflow entering the air guiding cavity 53 presses the sealing sheet 571. The sealing sheet 571 moves downward, thus opens the sealing hole 54*b*. Then, the airflow passes through the sealing hole 54*b* again, and enters the exhaust duct 23. The airflow is discharged to the external environment through the exhaust duct 23.

Figure 10C:
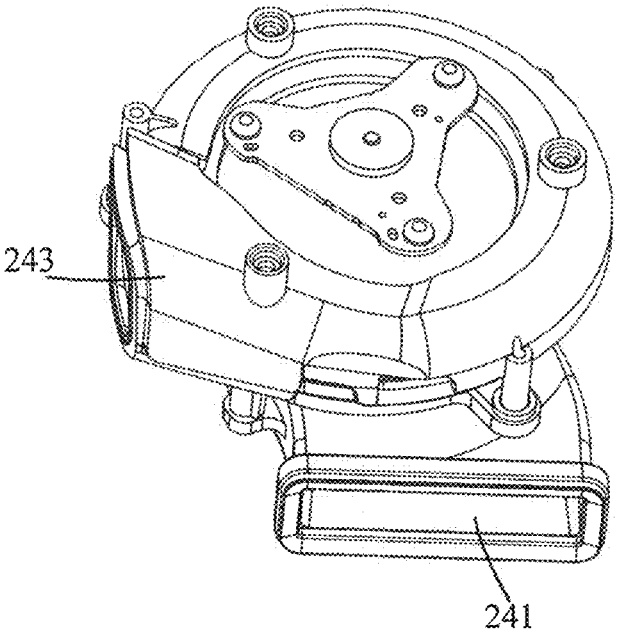
FIG. 10*c* is a perspective structural view of a fan module shown in FIG. 1.
Figure 10D:
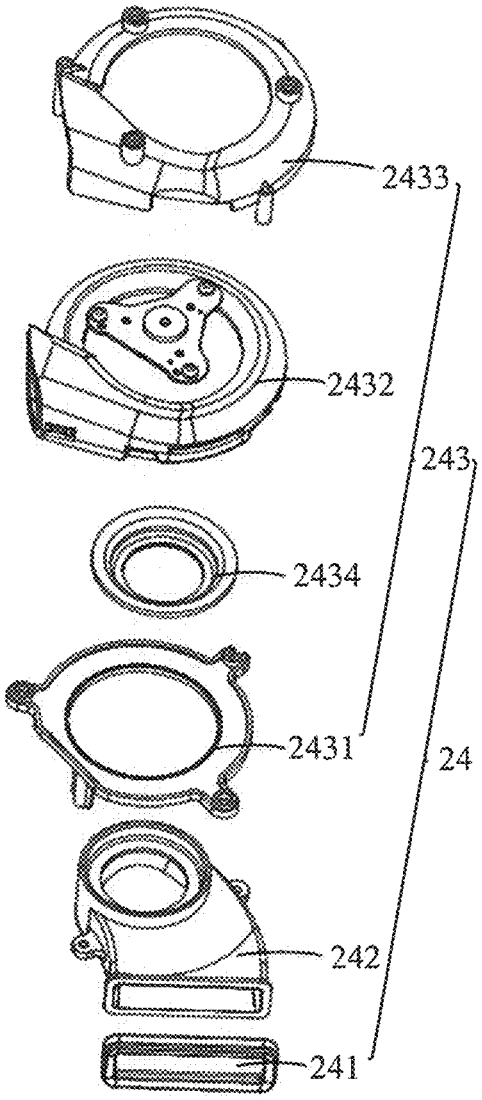
FIG. 10*d* is an exploded structural view of a fan module shown in FIG. 1.
Figure 11A:
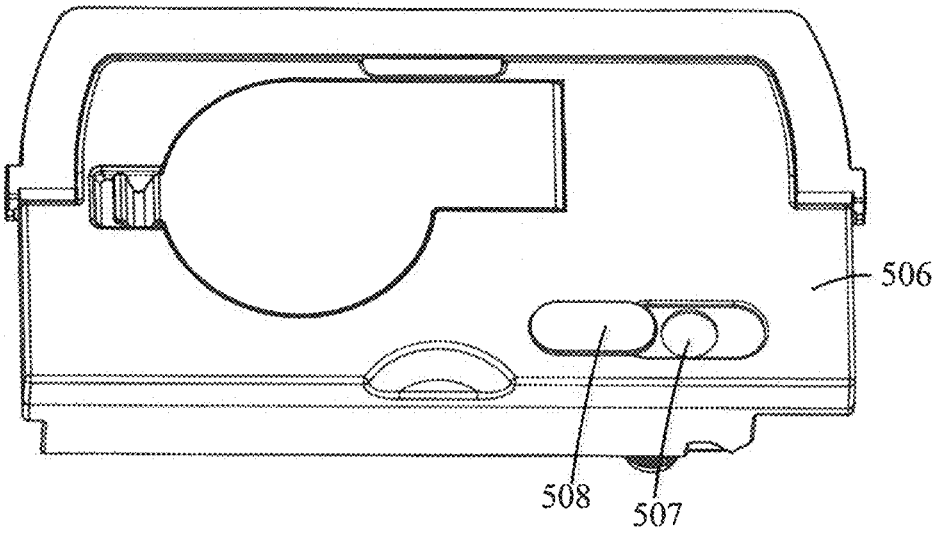
FIG. 11*a* is a top view of a water tank according to an embodiment of the present disclosure.
Figure 11B:
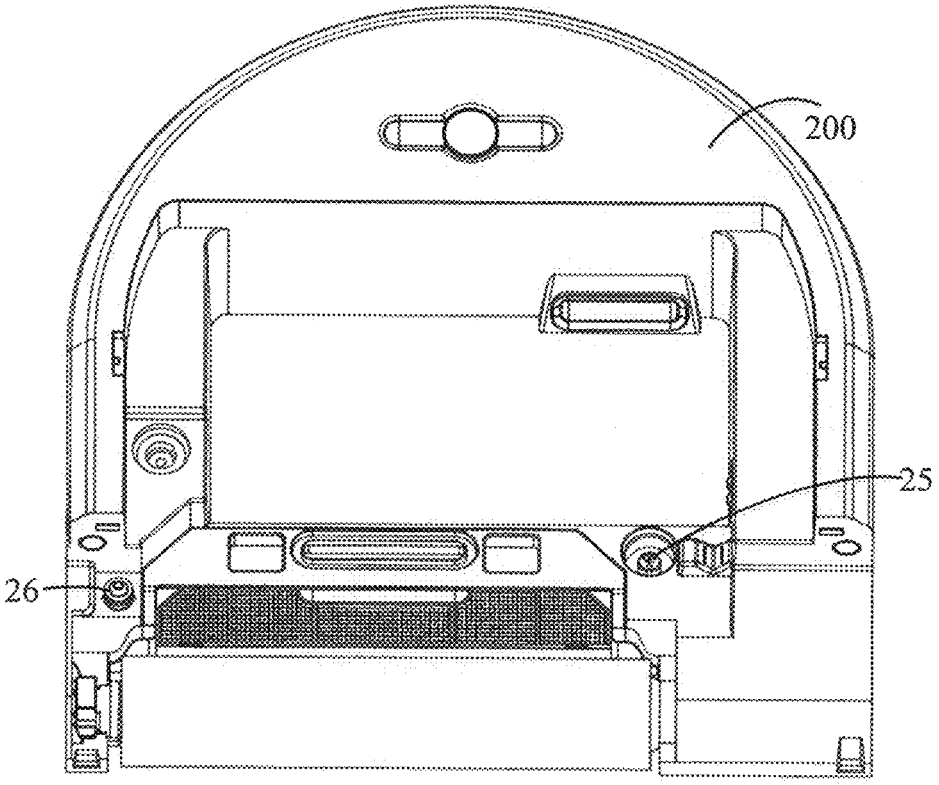
FIG. 11*b* is a perspective structural view of a machine body of FIG. 1 at a third angle.
Figure 11C:
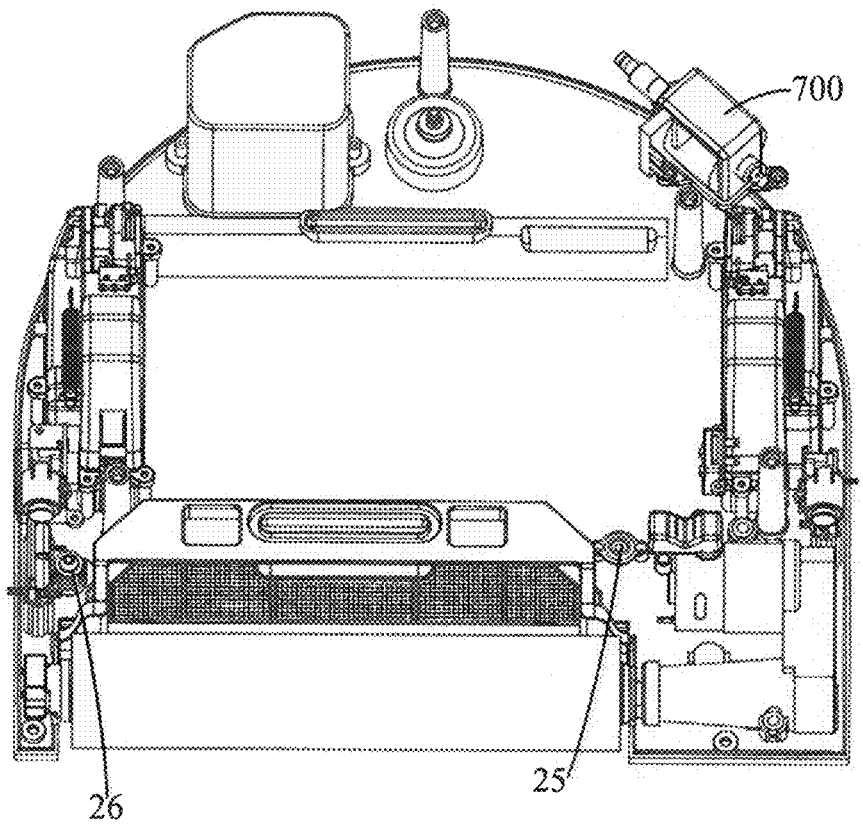
FIG. 11*c* is a perspective structural view of a machine body of FIG. 1 after hiding an outer shell.
Figure 11D:
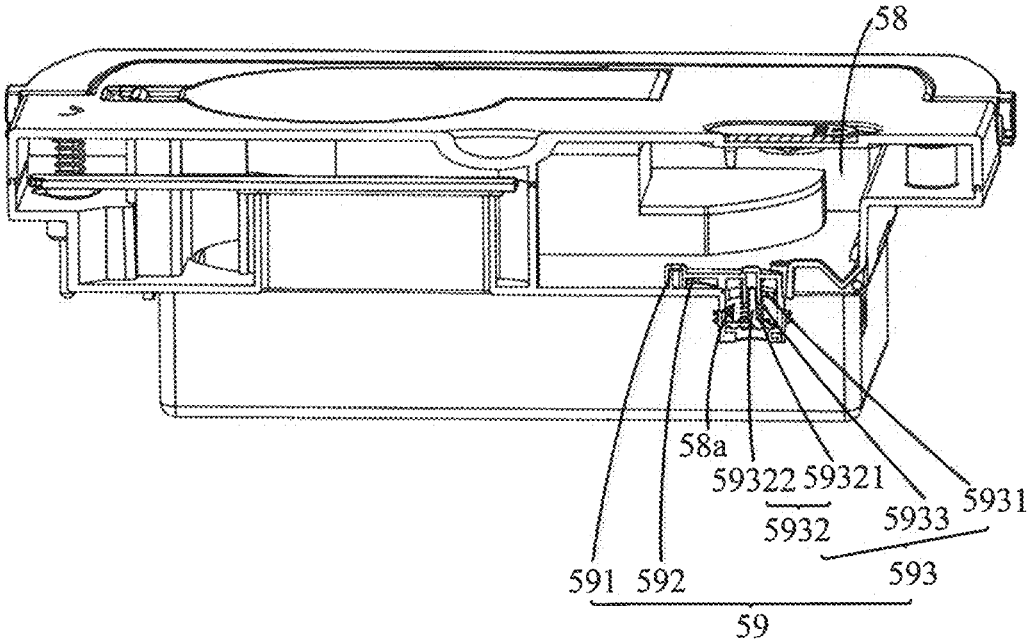
FIG. 11*d* is a second cross-sectional schematic view of a water tank according to an embodiment of the present disclosure.

Please referring to FIG. 10*c* and FIG. 10*d*, the fan module 24 includes an air nozzle 241, an air tube 242 and a fan component 243.

The air nozzle 241 is communicated with the exhaust duct 23, one end of the air tube 242 is communicated with the air nozzle 241, and the fan component 243 is communicated with the other end of the air tube 242 to provide the wind power to draw the wastewater into the water tank 500 through the wastewater outlet 40*a* and the wastewater inlet 50*a*.

In some embodiments, the fan component 243 includes a fan bracket 2431, a fan 2432, a fan support 2433, and a fan gasket 2434. The fan bracket 2431 is mounted at the other end of the fan tube 242 and is communicated with the fan tube 242. The fan 2432 is mounted on the fan bracket 2431 and is communicated with the fan tube 242. The fan support 2433 is mounted to the main body 21 and is connected to the fan 2432.

The fan module 24 with such a structure may efficiently and reliably provide wind power to the water tank 500

In some embodiments, the water tank 500 may also provide water to the cleaning assembly 300, so that the cleaning assembly 300 may complete the cleaning work efficiently, without being supplied with water manually.

Referring to FIG. 11*a* to FIG. 11*d*, the water tank 500 includes a water cavity 58. The water cavity 58 is configured to provide water for the cleaning assembly 300. In some embodiments, the upper cover 506 of the water tank 500 is provided with a water injection hole 507 which is communicated with the water cavity 58. The external water may be injected into the water cavity 58 through the water injection hole 507. The water in the water cavity 58 may naturally flow to the cleaning assembly 300, or the water may be pumped to the cleaning assembly 300 through a pump or other components.

In some embodiments, in order to prevent impurities such as external dust from polluting clean water through the water injection holes 507, the cover 506 is also provided with a hole cover 508 which is free to slide so as to cover or open the injection hole 507.

In some embodiments, the machine body 200 is provided with pumping component 700 which is communicated with the water cavity 58. The pumping component 700 is configured to draw water from the water cavity 58 and provide it to the cleaning assembly 300. For example, the pumping component 700 includes a pump, a first water tube and a second water tube. One end of the first water tube is communicated with the water cavity 58, and the other end of the first water tube is communicated with the inlet end of the pump. The outlet end of the pump is communicated with one end of the second water tube, and the other end of the second water tube abuts against the cleaning assembly 300.

The pump draws the water from the water cavity 58 through the first water tube, and supplies the water to the cleaning assembly 300 through the second water tube, so that the cleaning assembly 300 completes the cleaning work.

In order to reliably and flexibly supply water to the cleaning assembly 300, in some embodiments, while the water tank 500 is mounted in the machine body 200, the pumping component 700 may draw water from the water cavity 58.

For example, the main body 200 is provided with a main-unit water inlet connector 25 and a main-unit water outlet connector 26. One end of the pumping component 700 is connected to the main-unit water inlet connector 25 and the other end is connected to the main-unit water outlet connector 26.

The water cavity 58 is provided with a water outlet 58*a*. When the water tank 500 is mounted in the recess 20*a*, the water outlet 58*a* is communicated with the main-unit water inlet 25. Therefore, the pumping component 700 may draw water from the water cavity 58 through the main-unit water inlet connector 25, and output the water to the cleaning assembly 300 through the main-unit outlet connector 26.

The water easily contains some impurities, which will greatly affect the lifetime and working reliability of the cleaning assembly 300, when the water is provided to the cleaning assembly 300 for a long time.

Therefore, in some embodiments, the water tank 500 further includes a filter component 59 which surrounds the water outlet 58*a*. Before the water is supplied to the cleaning assembly 300, the filter component 59 may filter some impurities of the water, and the pumping component 700 then supplies the filtered water to the cleaning assembly 300.

In some embodiments, the filter component 59 includes a housing 591 and a fourth filter 592.

Figure 8A:
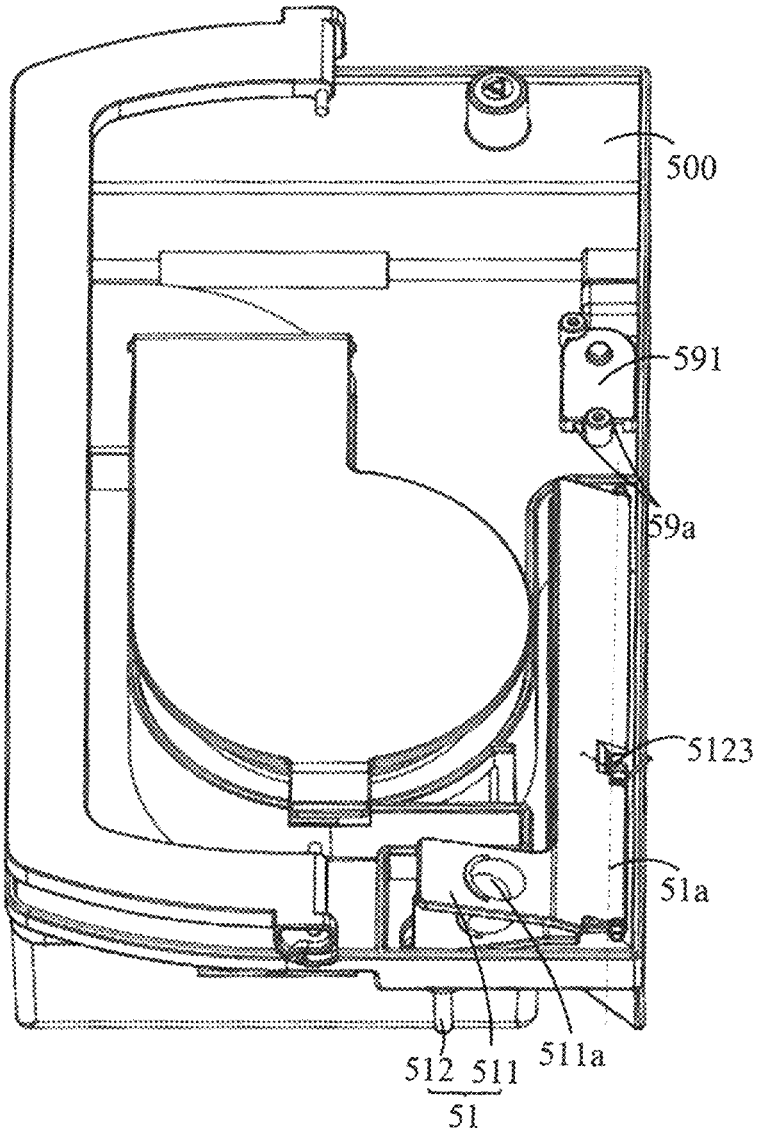
FIG. 8*a* is a schematic view of the position of a first sealing assembly in a water tank according to an embodiment of the present disclosure.
Figure 8B:
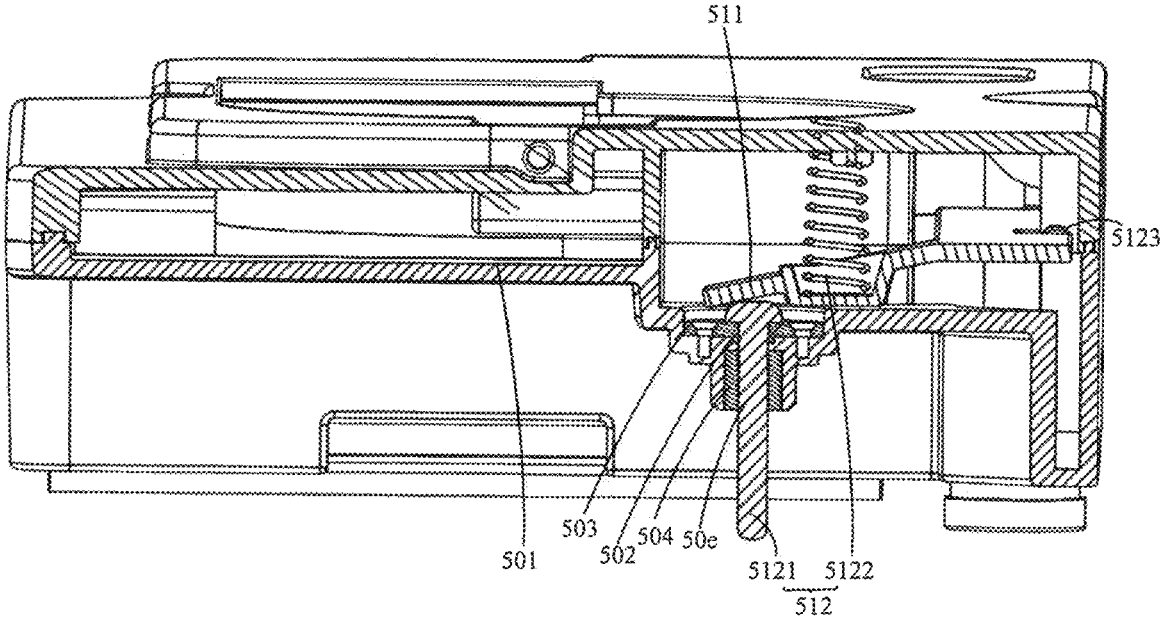
FIG. 8*b* is a schematic cross-sectional view of a first sealing assembly according to an embodiment of the present disclosure.
Figure 8C:
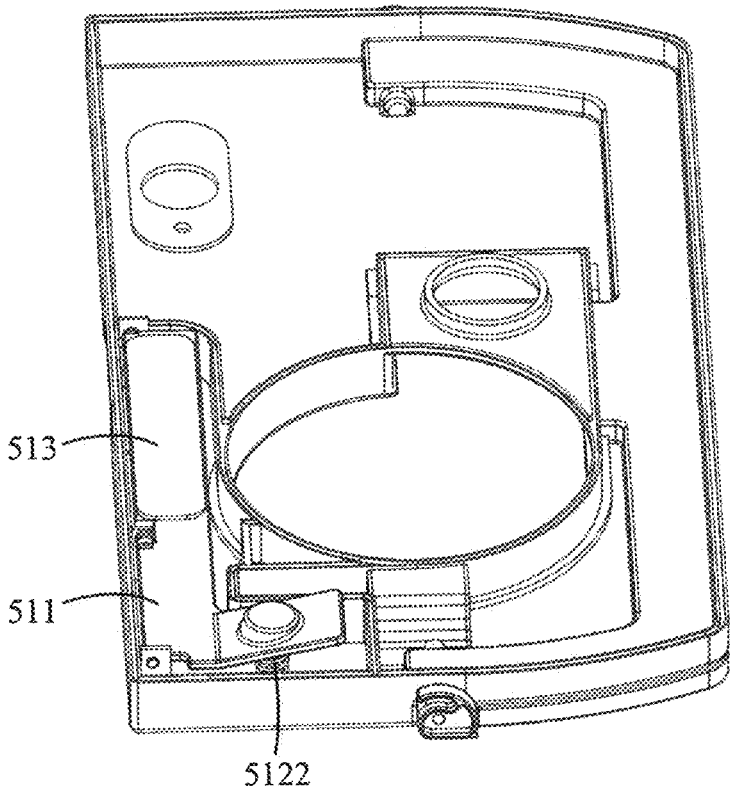
FIG. 8*c* is a schematic view of the position of a first sealing assembly at a water tank at a first angle according to an embodiment of the present disclosure.
Figure 8D:
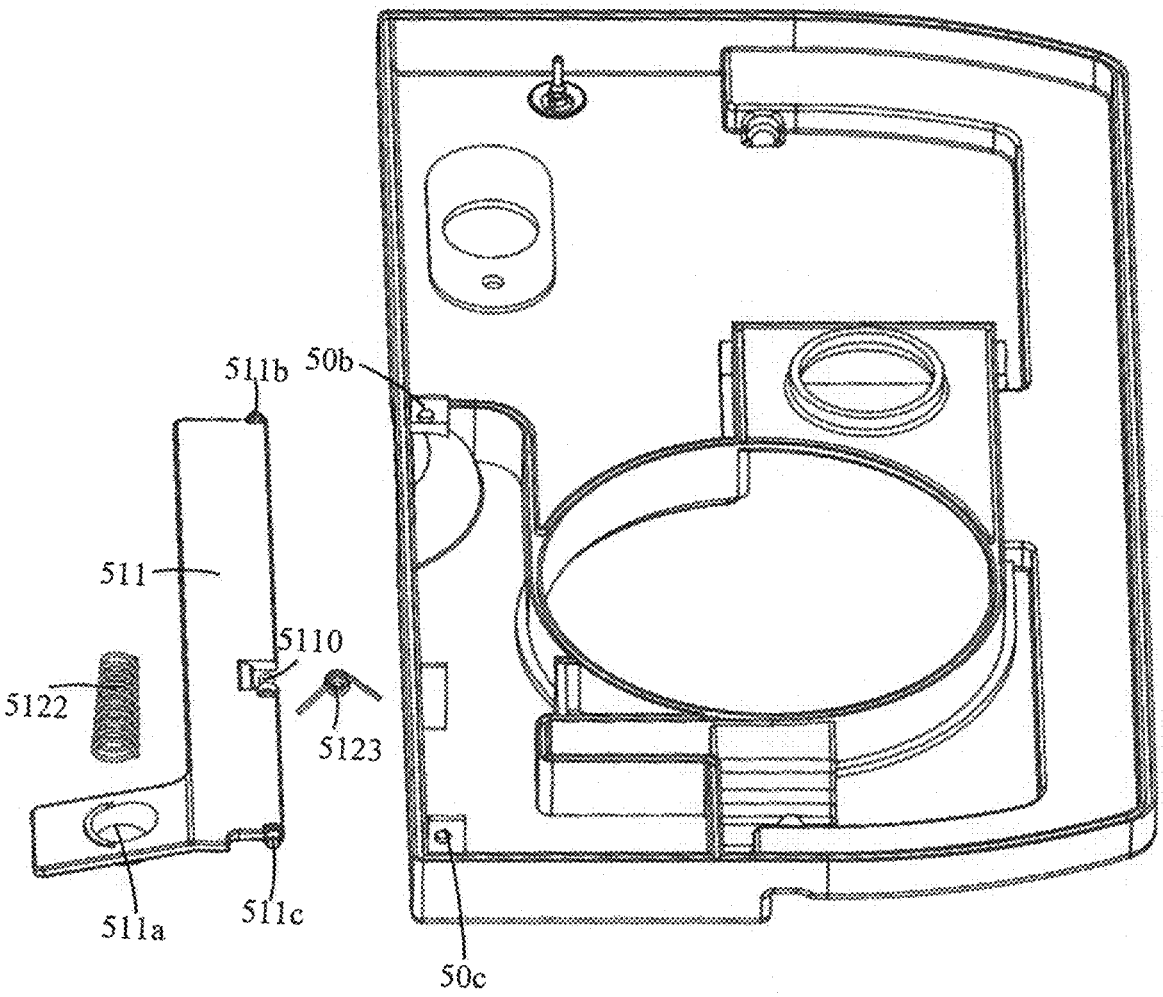
FIG. 8*d* is an exploded schematic view of a first sealing assembly according to an embodiment of the present disclosure.

Please referring to FIG. 8A, the housing 591 is provided with a filter inlet 59*a* and surrounds the water outlet 58*a*. The fourth filter 592 is mounted at the filter inlet 59*a*. Water flows into the water inlet 59*a* through the fourth filter 592. The water filtered by the fourth filter 592 is output through the water outlet 58*a*.

In some embodiments, the fourth filter 592 may adopt a metal filter or other suitable filter.

In some embodiments, the filter component 59 further includes a third sealing assembly 593 which is received in the housing 591 and is mounted at the water outlet 58*a* and is vertically movable along the axis of the water outlet 58*a*.

While the water tank 500 is mounted in the recess 20*a*, the main-unit water inlet connector 25 bears against the third sealing assembly 593 to move away from the water outlet 58*a* to open the water outlet 58*a*.

While the water tank 500 is removed from the recess 20*a*, the third sealing assembly 593 returns towards the water outlet 58*a* to seal the water outlet 58*a*.

Therefore, with such a sealing structure, when the water tank 500 is put into the machine body 200, the water in the water cavity 58 may be output from the water outlet 58*a*. When the water tank 500 is removed from the machine body 200, the water outlet 58*a* is sealed, and the water in the water cavity 58 may not be output to the outside.

It may be understood that the third sealing assembly 593 may adopt any suitable sealing structure. For example, in the embodiment, the third sealing assembly 593 includes a slide rail 5931 and a slider 5932.

The slide rail 5931 is mounted in the housing 591 towards the water outlet 58*a*. The slider 5932 is mounted in the water outlet 58*a* and is received in the slide rail 5931.

When the slider 5932 is beared against by the main-unit water inlet connector 25, the slider 5932 may move away from the water outlet 58 along the axis of the water outlet 58*a* to open the water outlet 58*a*.

When the slider 5932 is not beared against by the main-unit water inlet connector 25, the slider 5932 may move close to the water outlet 58 along the axis of the water outlet 58*a* to open the water outlet 58*a*.

In some embodiments, the slider 5932 includes a base 59321 and a guiding rod 59322. The base 59321 is mounted at the water outlet 58*a*. One end of the guiding rod 59322 is mounted on the base 59321, and the other end is received in the slide rail 5931.

When the base 59321 is beared against by the main-unit water inlet connector 25, the guiding rod 59322 carries the base 59321 to move away from the water outlet 58*a* in the slide rail 5931, so that the base 59321 opens the water outlet 58*a*, and thus the water may be output through the water outlet 58*a*.

When the slider 5932 is not beared against by the main-unit water inlet connector 25, the base 59321 pulls the guiding rod 59322 to move close to the water outlet 58*a* in the slide rail 5931, so that the base 59321 seals the water outlet 58*a*, and thus the water may not be output through the water outlet 58*a*.

In order to enable the slider 5932 to reliably seal or open the water outlet 58*a*, in some embodiments, the third sealing assembly 593 further includes a third resilient member 5933 which is sleeved on the slide rail 5931 and both ends of which bear against the housing 591 and the slider 5932 respectively. When the water outlet 58*a* is opened or sealed, the third resilient member 5933 is in a compressed state.

When the base 59321 is supported by the main-unit water inlet connector 25, the guiding rod 59322 carries the base 59321 to move away from the water outlet 58*a* in the slide rail 5931, and at the same time, the third resilient member 5933 is compressed, and thus the base 59321 opens the water outlet 58*a* and the water may be output through water outlet 58*a*.

When the slider 5932 is not beared against by the main-unit water inlet connector 25, the third resilient member 5933 resets and extends, so that the base 59321 is pushed to pull the guiding rod 59322 to move close to the water outlet 58*a* in the slide rail 5931, so that the base 59321 seals the water outlet 58*a* and thus the water may not be output through the water outlet 58*a*.

Since the front bumper 600 abuts against the cleaning assembly 300, in some embodiments, the front bumper 600 may be configured to provide water to the cleaning assembly 300, so as to supply water to the cleaning assembly 300 more effectively.

Figure 12A:
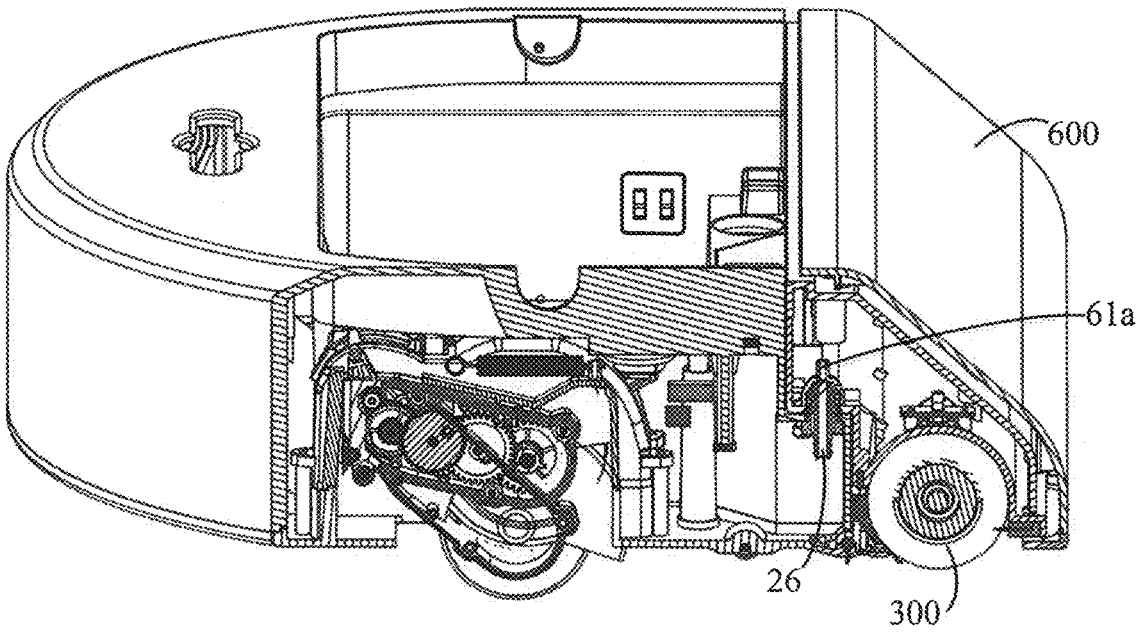
FIG. 12*a* is a fifth cross-sectional schematic view of a cleaning device according to an embodiment of the present disclosure.
Figure 12B:
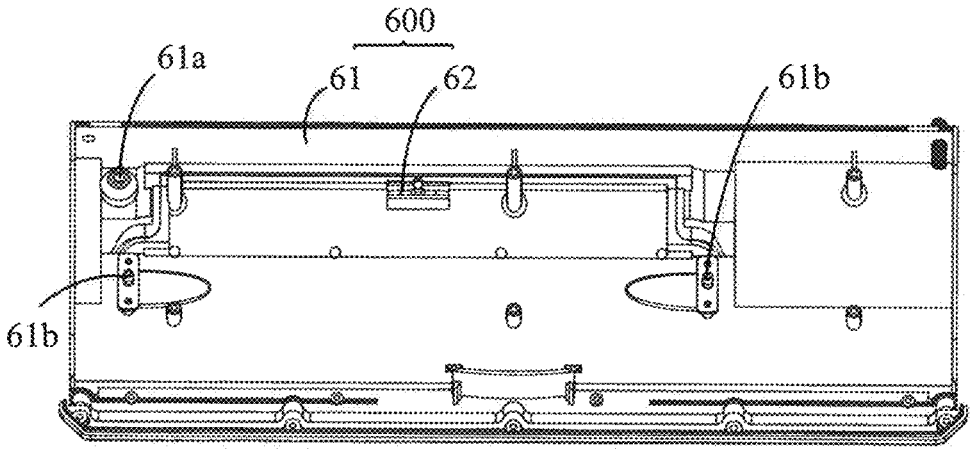
FIG. 12*b* is a schematic structural view of a front bumper according to an embodiment of the present disclosure.
Figure 13A:
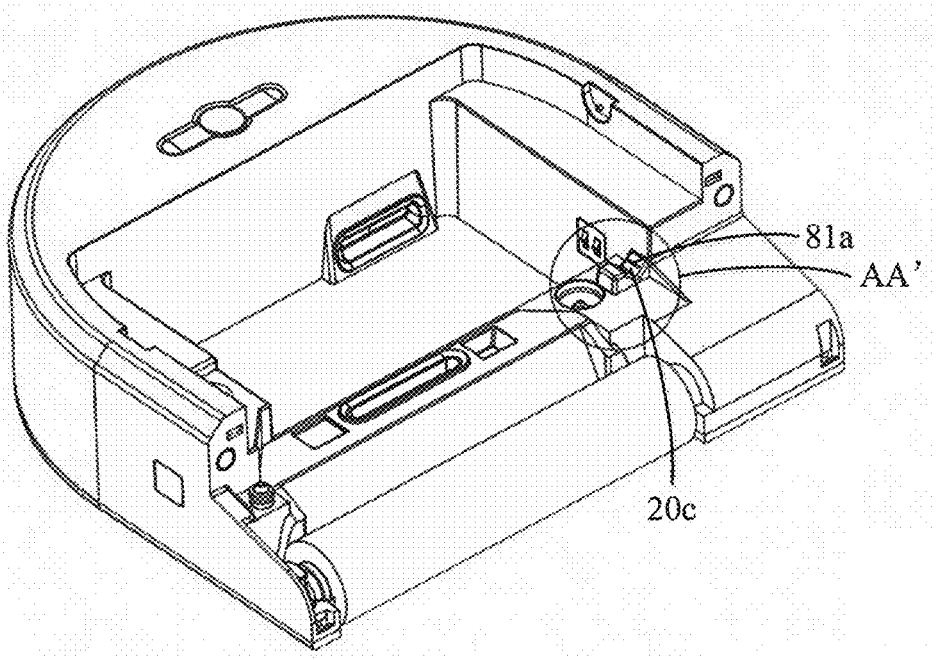
FIG. 13*a* is a perspective view of a machine body of FIG. 1 at a fourth angle.
Figure 13B:
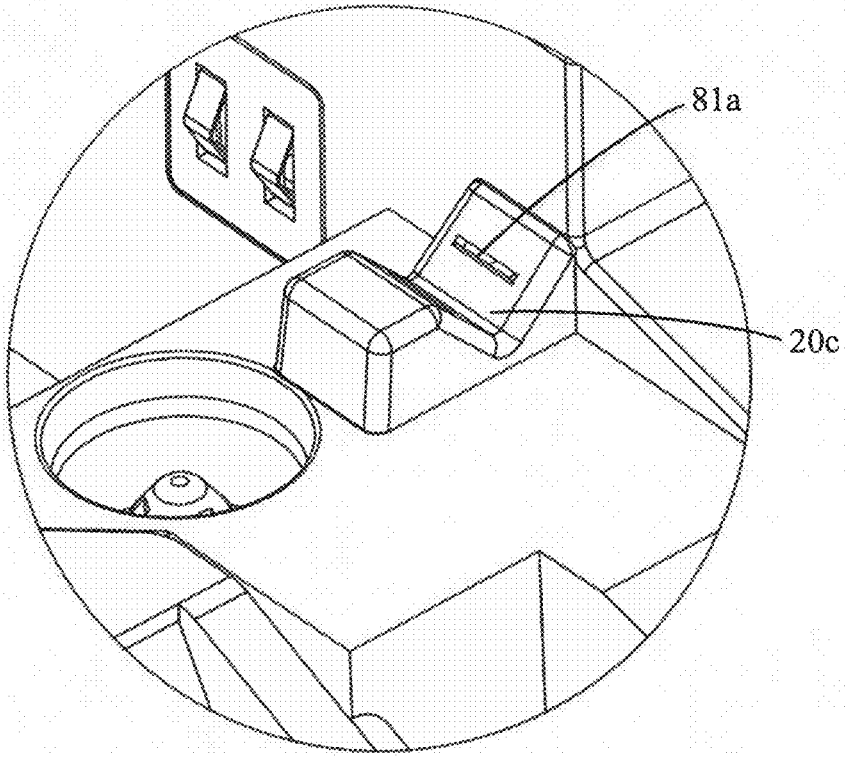
FIG. 13*b* is a schematic enlarged partial view of AA' portion of FIG. 13*a;*
Figure 13C:
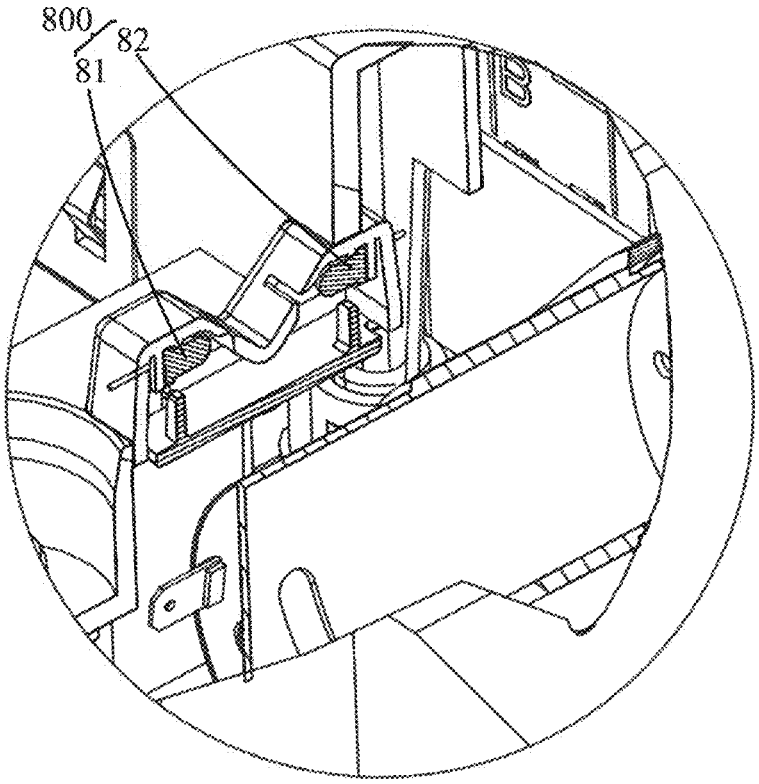
FIG. 13*c* is a cross-sectional view of FIG. 13*b;*
Figure 13D:
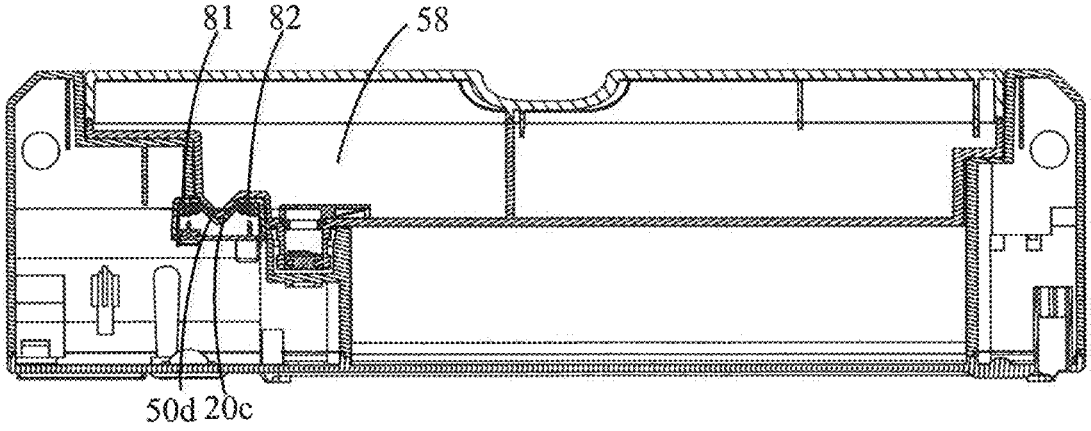
FIG. 13*d* is a second schematic cross-sectional view of a machine body of FIG. 1.
Figure 13E:
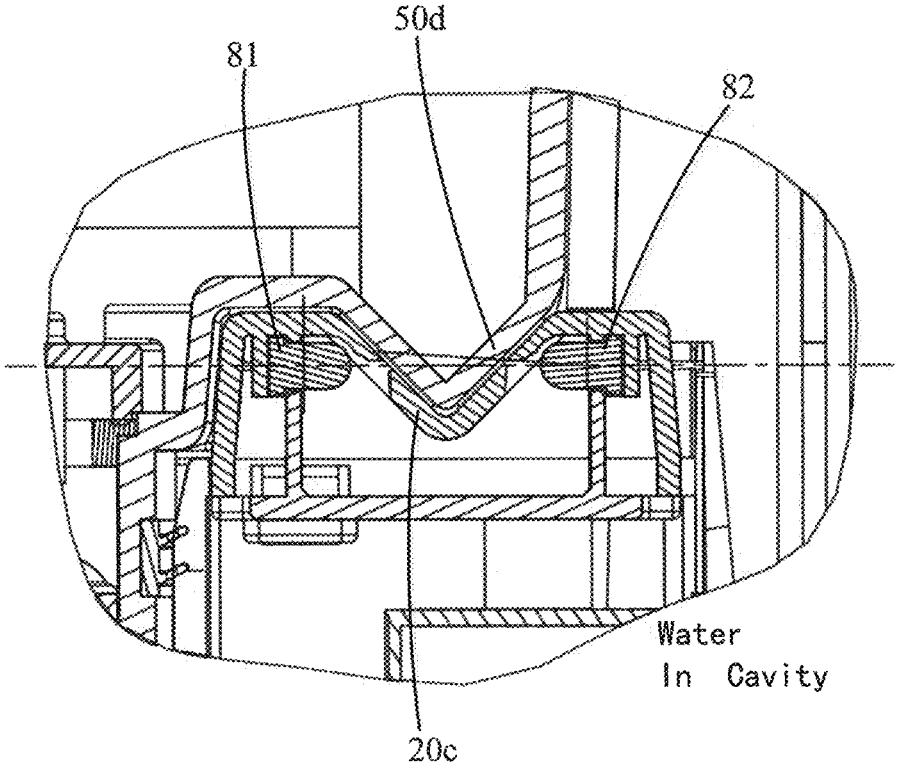
FIG. 13*e* is a third schematic cross-sectional view of a machine body of FIG. 1, showing that a water cavity of a water tank is empty.
Figure 13F:
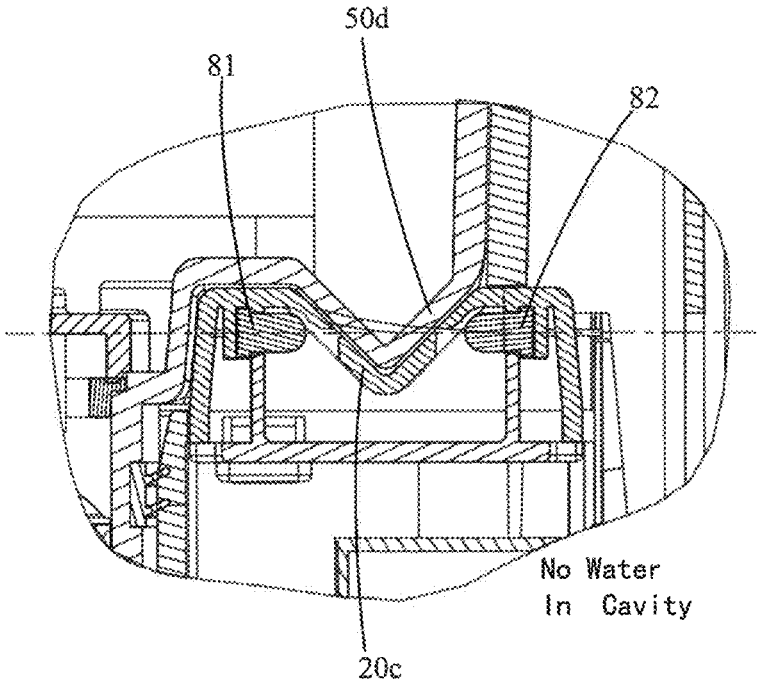
FIG. 13*f* is a fourth schematic cross-sectional view of a machine body of FIG. 1, showing that there is water in a water cavity of a water tank.

Please referring to FIG. 12*a* and FIG. 12*b*, the front bumper 600 includes a front bumper body 61 and a spray component 62.

The front bumper body 61 is provided with a front bumper water inlet 61*a* and a front bumper water outlet 61*b*. When the front bumper body 61 is removably mounted in the machine body 200, the front bumper water inlet 61*a* is communicated with the main-unit water outlet connector 26, and the front bumper water outlet 61*b* is opposite to the cleaning assembly 300.

One end of the spray component 62 is communicated with the front bump water inlet 61*a*, and the other end is communicated with the front bump water outlet 61*b*.

In the embodiment, the pumping component 700 supplies water to the front bumper 600 through the main-unit water outlet connector 26 and the front bumper inlet 61*a*. The spray component 62 receives the water through the front water bumper outlet 61*a*, divides the water, and output them to the cleaning assembly 300 through the front bumper water outlet 61*b*.

It may be understood that the spray component 62 may adopt any suitable spray structure. For example, in the embodiment, the number of the front bumper water outlet 61*b* is two, which are respectively located on both ends of the same side of the front bumper body 61 towards the cleaning assembly 300. The spray component 62 includes two water outlet tubes and a three-way valve. One end of each water outlet tube is communicated with the three-way valve, and the other end of each water outlet tube is respectively connected to the corresponding front bump water outlet 61*b*. Therefore, the water is sprayed to the cleaning assembly 300 through the corresponding front bump water outlet 61*b* after being divided by the three-way valve.

In some embodiments, the cleaning assembly 300 may occasionally carry relatively large pieces of trash when cleaning trash and debris. The front bumper 600 may scrape away the large pieces of trash first, and then a part of the trash and wastewater enter the collecting assembly 400. Please referring to FIG. 4, the front bumper 600 further includes a second scraping bar 63 which is mounted in the front bumper body 61 and abuts against the cleaning assembly 300. The second scraping bar 63 may scrape away the trash and debris carried by the cleaning assembly 300.

When the water in the water cavity 58 is used up or the waste water cavity 52 is full of the wastewater, the user needs to be notified of the liquid storage state of the water cavity 58 or the liquid storage state of the wastewater cavity 52. Therefore, in some embodiments, the cleaning device 100 further includes a liquid level detecting component 800. When the water tank 500 is mounted in the tank position 20*a*, the liquid level detecting component 800 is configured to detect the liquid storage state of the water tank 500. The liquid storage state includes the height of the liquid level, whether the water has been used up or whether the wastewater exceeds the warning value, etc.

In some embodiments, the liquid level detecting component 800 may be mounted in any suitable position, for example, it may be mounted in the machine body 200 or may be mounted in the water tank 500.

Please referring to FIG. 13*a* to FIG. 13*f*, the water tank 500 is provided with a protrusion 50*d* that may store liquid, for example, the protrusion 50*d* protrudes from the bottom of the water cavity 58. It may be understood that the protrusion 50*d* may also be provided in any suitable position in the water tank 500 or the water cavity 58.

In the embodiment, the liquid level detecting component 800 is mounted in the machine body 200, and is configured to determine the liquid storage state of the water tank 500 by detecting the liquid level state of the protrusion 50*d*.

It may be understood that the liquid level detecting component 800 may adopt any suitable detecting structure. For example, the liquid level detecting component 800 includes a probe component and a water level detecting circuit. The water level detecting circuit detects the water status of the water cavity 58 by the probe component.

For another example, the machine body 200 includes a recess 20*c* adapted to the protrusion 50*d*. When the water tank 500 is mounted in the recess 20*a*, the protrusion 50*d* is received in the recess 20*c* and the liquid level detecting component 800 may detect the liquid level state of the protrusion 50*d* from now.

The liquid level detecting component 800 includes an emitting diode 81 and a receiving diode 82 which are arranged at two opposite sides of the recess 20*c*. The receiving diode 82 is configured to receive the light emitted by the emitting diode 81. In some embodiments, the emitting diode 81 and the receiving diode 82 are directly opposed to each other.

In some embodiments, both opposite sides of the recess 20*c* may be provided with via holes 81*a*, wherein the emitting diode 81 is provided at the via hole 81*a* on one side of the recess 20*c*, and the receiving diode 82 is provided at the via hole 81*a* on the other side of the recess 20*c*. The light generated by the emitting diode 81 may enter the protrusion 50*d* through the via hole 81*a* on the one side of the recess 20*c*, then be emitted from the protrusion 50*d* to the via hole 81*a* on the other side of the recess 20*c*, and finally enter the receiving diode 82 through the via hole 81*a* on the other side of the recess 20*c*.

It may be understood that the recess 20*c* may be provided with the via hole 81*a* on one side, and the via hole 81*a* may be provided on the side of the emitting diode 81 or the side of the receiving diode 82.

It may be understood that the recess 20*c* may not need to be provided with a via hole. In some embodiments, the protrusion 50*d* and the recess 20*c* are made of a light-transmitting material, and the light generated by the emitting diode 81 may pass through the protrusion 50*d* and the recess 20*c* and be received by the receiving diode 82.

In the embodiment, when the liquid is stored in the protrusion 50*d* of the water tank 500, the emitted light is refracted in the liquid in the protrusion 50*d* and is not received by the receiving diode 82.

When there is no liquid in the protrusion 50*d* of the water tank 500, the emitted light passes through the protrusion 50*d* and is received by the receiving diode 82, so that the user may be notified that the water in the water cavity 58 is used up.

In some embodiments, the cleaning device 100 further includes a detecting circuit. The receiving diode 82 is electrically connected to the detecting circuit. The receiving diode 82 generates an electrical signal based on the emitted light, so that the detecting circuit sends an early warning signal based on the electrical signal. For example, when the receiving diode 82 does not receive the emitted light, the receiving diode 82 does not generate the electrical signal. The detecting circuit detects that there is no electrical signal input, and thus determines that there is water in the water cavity 58. When the receiving diode 82 receives the emitted light, the receiving diode 82 generates an electrical signal, and the detecting circuit detects that there is the electrical signal input, and determines that there is no water in the water cavity 58, so an early warning signal may be generated.

It may be understood that the electrical signal may be at a high level or a low level, or may be other types of suitable signals.

It may be understood that the early warning signal may be a voice signal, an optical signal, a message, and so on. The cleaning device 100 may post the early warning signal to the background, user terminal, and so on.

It may be understood that the detecting circuit may be a microprocessor or other electronic chip with logic control.

It may be understood that the light according to the embodiment may be of any color, such as infrared light and the like.

It may be understood that the protrusion 50*d* and the recess 20*c* may be configured into any suitable shape, such as a V shape.

Figure 14A:
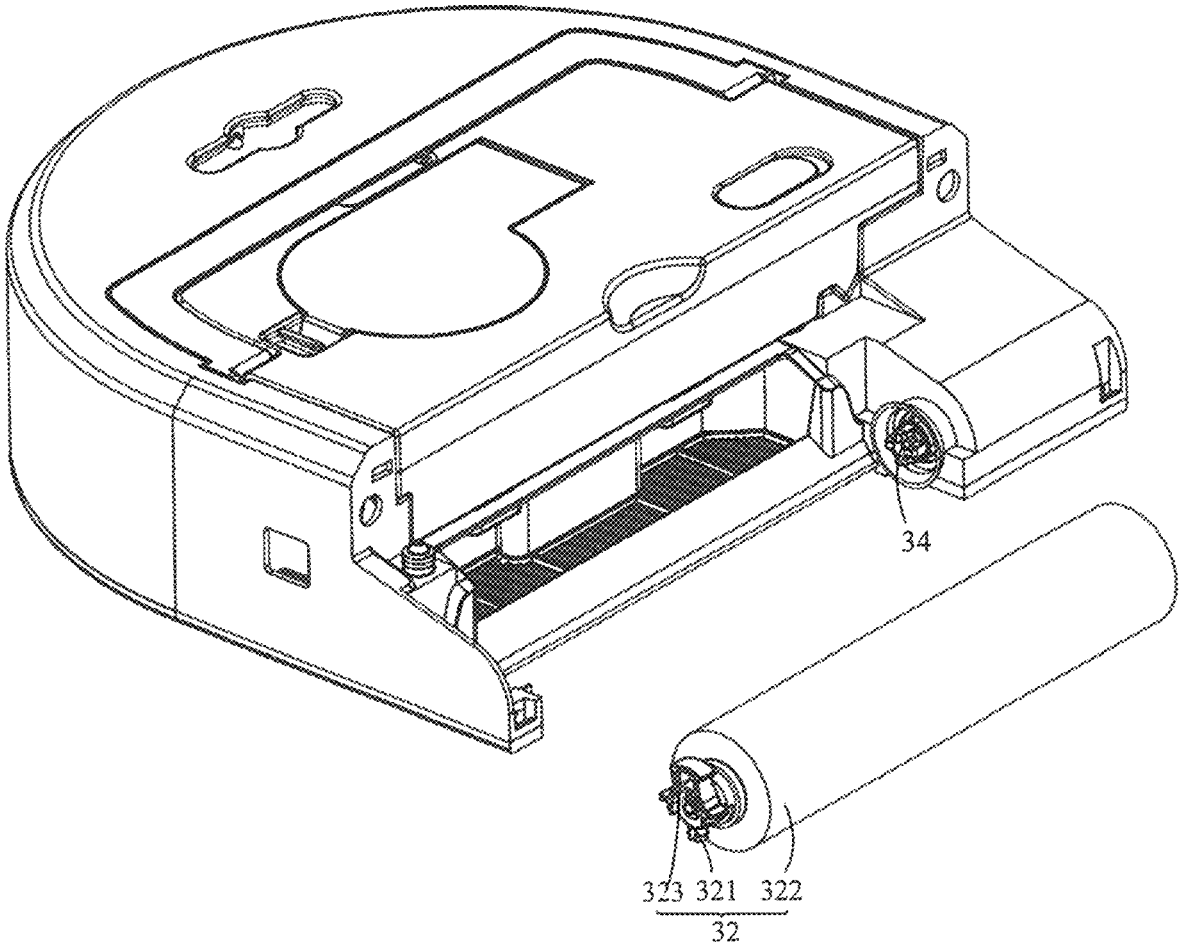
FIG. 14*a* is a perspective structural view of a machine body of FIG. 1 at a fifth angle.
Figure 14B:
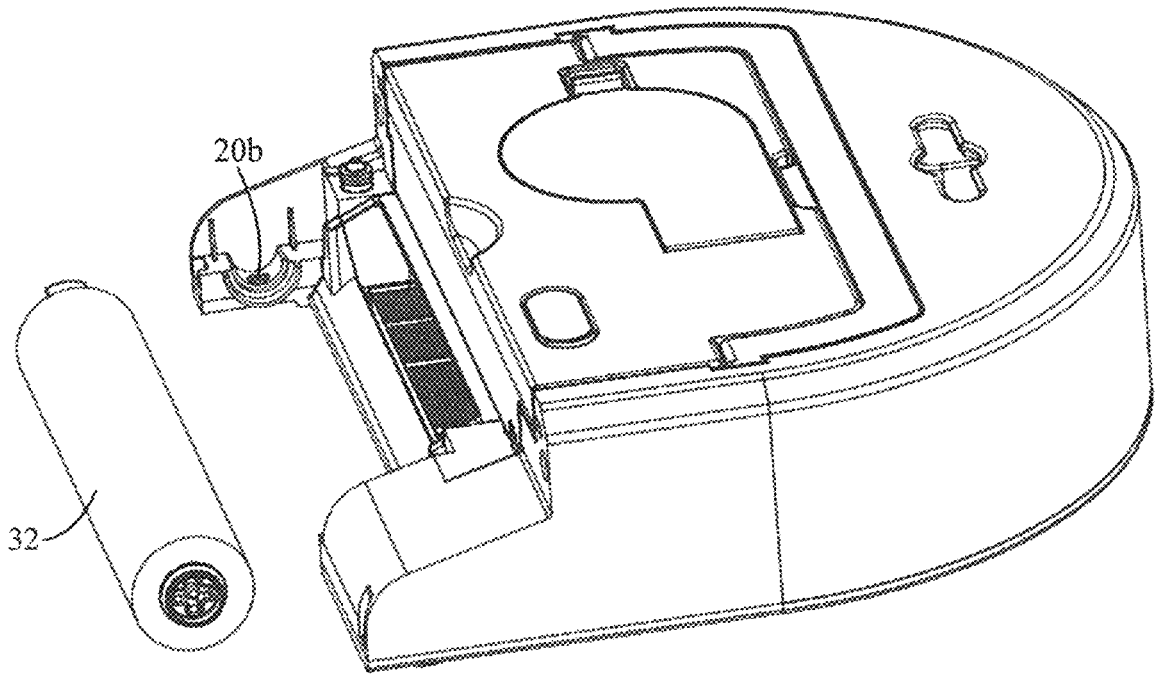
FIG. 14*b* is a perspective structural view of a machine body of FIG. 1 at a sixth angle.

After the water in the water cavity 58 is supplied to the cleaning assembly 300, the cleaning assembly 300 may perform the cleaning work. In some embodiments, referring to FIG. 14*a* and FIG. 14*b*, the cleaning assembly 300 includes a roller 32 and a motor component 34.

The roller 32 is movably mounted in the machine body 200. Generally, the roller 32 will carry some wipers and the like, and when the roller 32 rotates, the wiper will also rotate accordingly.

The motor component 34 is mounted in the machine body 200 and connected to the roller 32. The motor component 34 is configured to drive the roller 32 to rotate.

It may be understood that the motor component 34 may adopt any suitable motor drive structure. For example, the motor component 34 includes a motor and a drive shaft. The output end of the motor is connected to one end of the drive shaft, and the other end of the drive shaft is connected to the roller 32. The motor generates a driving force and drives the roller 32 to rotate through the drive shaft.

In some embodiments, the machine body 200 is provided with an engaging slot 20*b*. The roller 32 includes a engaging protrusion 321 and a roller body 322. The engaging protrusion 321 is configured to be engaged with the buckle slot 20*b*. One end of the roller body 322 is rotatable mounted on the engaging protrusion 321, and the other end is connected to the motor component 34. For example, the engaging protrusion 321 is provided with a bearing hole which is provided with a bearing. One end of the roller body 322 is mounted and fixed in the shaft hole of the bearing, and the other end of the roller body 322 has a four-corner slot structure. The motor component 34 may be reliably and stably connected to the roller body 322. Therefore, the roller body 322 may rotate relative to the engaging protrusion 321.

In some embodiments, the engaging protrusion 321 may be a semi-curved elastic engaging, which not only facilitates the engaging protrusion 321 to be engaged with the engaging slot 20*b*, but also facilitates the roller body 322 to be removed from the engaging slot 20*b*.

In some embodiments, in order to facilitate the user to remove the roller body 322, the roller 32 includes a lifting protrusion 323 which is opposite to the engaging protrusion 321. When the engaging projection 321 is engaged with the engaging slot 20*b*, the lifting protrusion 323 is upward in the vertical direction. When the roller body 322 needs to be removed, the user holds the lifting protrusion 323 and may lift the engaging protrusion 321 from the engaging slot 20*b*.

Finally, it should be noted that the above embodiments are only for illustrating the technical solutions of the present disclosure, rather than limiting them; under the idea of the present disclosure, the technical features in the above embodiments or different embodiments may also be combined. The steps may be implemented in any order, and there are many other variations of the different aspects of the present disclosure as described above. For simplicity, they are not provided in the details; although the present disclosure has been described in detail with reference to the foregoing embodiments, the skilled in the art should understand that they may still modify the technical solutions described in the foregoing embodiments, or equivalently replace some of the technical features; and these modifications or replacements do not make the essence of the corresponding technical solutions deviate from the scope of the technical solutions of the embodiments of the present disclosure.

What is claimed is:

1. A cleaning device, comprising:

a machine body provided with a recess;

a front bumper mounted on the machine body;

a cleaning assembly comprising a roller configured to clean the ground, wherein the roller is mounted between the machine body and the front bumper;

a collecting assembly provided with a wastewater outlet, wherein the collecting assembly is mounted between the machine body and the roller, abutting against the roller and configured to collect and separate trash and wastewater carried by the cleaning assembly; and a water tank provided with a wastewater inlet, wherein the water tank is removably mounted in the recess, and the wastewater flows into the water tank through the wastewater outlet and the wastewater inlet, wherein the collecting assembly is located between the roller and the water tank;

wherein the collecting assembly comprises:

a separating assembly mounted in the machine body and abutting against the cleaning assembly, wherein the separating assembly is configured to collect and separate the trash and wastewater carried by the cleaning assembly; and a flowing tube mounted on the separating assembly, wherein the flowing tube is communicated with the separating assembly, and the flowing tube is provided with the wastewater outlet;

wherein the separating assembly comprises:

a separating main board removably mounted on the machine body, wherein the separating main board is provided with a filter groove, and the flowing tube is mounted on the separating main board and is communicated with the filter groove; and a first filter mounted on a notch of the filter groove and configured to collect and separate the trash and wastewater carried by the cleaning assembly;

wherein an end of the flowing tube that is away from the wastewater outlet passes through the first filter to be below the first filter, when trash and wastewater are brought into a collecting cavity of the separating main board, the trash is isolated outside by the first filter, and the wastewater flows into the flowing tube after filtered by the first filter under an action of wind force, and then enters the wastewater inlet of the water tank from the wastewater outlet of the flowing tube, wherein the wastewater outlet is the other end of the flowing tube.

2. The cleaning device according to claim 1, wherein the flowing tube comprises:

a tube body, wherein one end of the tube body is communicated with the separating assembly, and the wastewater outlet is provided at the other end of the tube body; and a flow-guiding part mounted in the tube body and configured to guide the wastewater out of the wastewater outlet.

3. The cleaning device according to claim 2, wherein the flow- guiding part comprises a first curved surface portion and a second curved surface portion, the first curved surface portion and the second curved surface portion cooperate to form a flow guiding channel and the width of the flow guiding channel gradually narrows from one end to the other in the vertical upward direction.

4. The cleaning device according to claim 1, wherein the separating assembly further comprises a transition plate which is mounted on the separating main board and extends towards the bottom of the cleaning assembly to abut against the cleaning assembly.

5. The cleaning device according to claim 4, wherein the separating assembly further comprises a first scraping bar which is mounted at the abutment between the transition plate and the cleaning assembly.

6. The cleaning device according to claim 1, wherein the separating main board is provided with a positioning groove; and the water tank is provided with a positioning protrusion, wherein the wastewater inlet is communicated with the wastewater outlet when the positioning protrusion is engaged with the positioning groove.

7. The cleaning device according to claim 1, wherein the water tank comprises:

a wastewater cavity communicated with the wastewater inlet;

an air guiding cavity opposite to the wastewater cavity;

a partition plate mounted between the wastewater cavity and the air guiding cavity and provided with a filter hole;

a second filter mounted in the filter hole, wherein the wastewater is collected by the wastewater cavity, and the airflow mixed with the wastewater successively flows out through the wastewater cavity, the second filter, and the air guiding cavity.

8. The cleaning device according to claim 7, wherein the machine body comprises:

a main body;

a driving assembly mounted in the main body, and configured to drive the main body to travel;

a exhaust duct mounted in the main body and communicated with the air guiding cavity; and a fan module mounted to the exhaust duct to provide wind power to draw the wastewater into the water tank through the wastewater outlet and the wastewater inlet.

9. The cleaning device according to claim 7, wherein the water tank comprises a first sealing assembly movably mounted on the wastewater inlet and rotating around a baseline relative to the wastewater inlet to seal or open the wastewater inlet.

10. The cleaning device according to claim 9, wherein the first sealing assembly comprises:

a sealing flap plate movably mounted in the water tank and abutting against the wastewater inlet;

a linkage transmission mechanism connected to the sealing flap plate, and driving the sealing flap plate to rotate around the baseline in a first direction or a second direction relative to the wastewater inlet, so that the sealing flap plate opens or seals the wastewater inlet; and a sealing foam arranged on the surface of the sealing flap plate facing the wastewater inlet to seal the wastewater inlet.

11. The cleaning device according to claim 10, wherein the water tank is provided with a first rotation hole and a second rotation hole, and the sealing flap plate is provided with a first rotation protrusion and a second rotation protrusion, wherein the first rotation protrusion is mounted in the first rotation hole, and the second rotation protrusion is mounted in the second rotation hole, wherein the baseline penetrates the first rotation hole and the second rotation hole.

12. The cleaning device according to claim 10, wherein the linkage transmission mechanism comprises:

a lifting pin wherein one end of the lifting pin is connected to the sealing flap plate, and the other end of the lifting pin is suspended toward the machine body, wherein a lower cover of the water tank is provided with a through hole, and the lifting pin is moved up and down in the through hole under the action of external force, and when the lifting pin is moved upward, the sealing flap plate is pushed to rotate by the lifting pin; and a first resilient member wherein one end of the first resilient member bears against the water tank, and the other end of the first resilient member bears against the sealing flap plate, when the external force is removed from the lifting pin, the first resilient member in a compressed state stretches, causing the sealing flap plate to turn over to seal the wastewater inlet.

13. The cleaning device according to claim 12, wherein the sealing flap plate is provided with a through hole, wherein the other end of the first resilient member passes through the through hole and is connected to the sealing flap plate, wherein an axis of the first resilient member intersects an axis of the through hole.

14. The cleaning device according to claim 12, wherein the linkage transmission mechanism further comprises a torsion spring, wherein the sealing flap plate is provided with a positioning column, and the torsion spring is sleeved on the positioning column, wherein one end of the torsion spring bears against the sealing flap plate, and the other end of the torsion spring bears against the inner side wall of the water tank.

15. The cleaning device according to claim 7, wherein the wastewater cavity is cylindrical and is provided with a tangential inlet along the circumscribed direction, and the tangential inlet is communicated with the wastewater inlet, wherein the airflow mixed with wastewater directly centrifugally moves along the tangential inlet, wherein the wastewater in the airflow falls into the wastewater cavity by the gravity.

16. The cleaning device according to claim 7, wherein the wastewater cavity, the air guiding cavity and the partition plate are integrally formed or separately formed.

17. The cleaning device according to claim 7, wherein the water tank further comprises a third filter, which is mounted in the air guiding cavity, and which is annular and surrounds the filter hole and is opposite to the second filter.

18. The cleaning device according to claim 9, wherein the partition plate is further provided with a sealing hole and the water tank further comprises a second sealing assembly, which is mounted in the sealing hole and vertically movable along an axis of the sealing hole to open or seal the sealing hole.

19. The cleaning device according to claim 3, wherein the first curved surface portion is protruded from an inner wall of the flowing tube, and the second curved surface portion is protruded from the inner wall of the flowing tube and is opposite to the first curved surface portion.

* * * * *